US009147929B2

(12) United States Patent
Anguera et al.

(10) Patent No.: US 9,147,929 B2
(45) **Date of Patent: *Sep. 29, 2015**

(54) ANTENNALESS WIRELESS DEVICE COMPRISING ONE OR MORE BODIES

(75) Inventors: Jaume Anguera, Vinaros (ES); Aurora Andujar, Rubi (ES)

(73) Assignee: Fractus, S.A., Barcelona (ES)

( * ) Notice: Subject to any disclaimer, the term of this patent is extended or adjusted under 35 U.S.C. 154(b) by 370 days.

This patent is subject to a terminal disclaimer.

(21) Appl. No.: 13/552,311

(22) Filed: Jul. 18, 2012

(65) Prior Publication Data

US 2012/0299786 A1 Nov. 29, 2012

Related U.S. Application Data

(63) Continuation of application No. PCT/EP2011/000472, filed on Feb. 2, 2011.

(60) Provisional application No. 61/300,573, filed on Feb. 2, 2010.

(30) Foreign Application Priority Data

Feb. 2, 2010 (EP) ..... 10152402
Jul. 21, 2010 (ES) ..... 201031121

(51) Int. Cl.
*H01Q 1/24* (2006.01)
*H01Q 1/48* (2006.01)

(52) U.S. Cl.
CPC . *H01Q 1/243* (2013.01); *H01Q 1/48* (2013.01)

(58) Field of Classification Search
CPC ..... H01Q 1/48; H01Q 1/243
See application file for complete search history.

(56) References Cited

U.S. PATENT DOCUMENTS 4,491,843 A 1/1985 Boubouleix
4,843,468 A 6/1989 Drewery (Continued)

FOREIGN PATENT DOCUMENTS

CN 1649206 8/2005
CN 201069869 6/2008

(Continued)

OTHER PUBLICATIONS

Rahola , J. ; Ollikainen , J., Optimal antenna placement for mobile terminals using characteristic mode analysis, Antennas and Propagation (EUCAP), 1st , Nice, 2006. European Conference on, Nov. 2006.

(Continued)

*Primary Examiner* — Trinh Dinh
(74) *Attorney, Agent, or Firm* — Edell, Shapiro & Finnan LLC

(57) ABSTRACT

An antennaless wireless handheld or portable device includes first and second bodies and a hinge mechanically connecting the two bodies. The hinge allows at least one of the two bodies to pivotally move about an axis so that the wireless device can be switched between a closed position in which one of the bodies is substantially arranged on top of the other and an open position in which the first body extends away from the hinge along a first direction and the second body extends away from the hinge along a second direction. A communication module of the wireless device includes a radiating system capable of transmitting and receiving electromagnetic wave signals in a first frequency region and in a second frequency region, wherein the highest frequency of the first frequency region is lower than the lowest frequency of the second frequency region.

20 Claims, 16 Drawing Sheets

(56) References Cited

U.S. PATENT DOCUMENTS

| | | | | |
|---|---|---|---|---|
| 5,363,114 | A | 11/1994 | Shoemaker | |
| 5,489,912 | A | 2/1996 | Holloway | |
| 5,657,386 | A | 8/1997 | Schwanke | |
| 5,666,125 | A | 9/1997 | Luxon | |
| 5,784,032 | A | 7/1998 | Johnston | |
| 5,826,201 | A | 10/1998 | Gratias | |
| 5,903,822 | A | 5/1999 | Sekine | |
| 6,011,518 | A | 1/2000 | Yamagishi | |
| 6,087,990 | A | 7/2000 | Thill et al. | |
| 6,133,883 | A | 10/2000 | Munson | |
| 6,211,826 | B1 | 4/2001 | Aoki | |
| 6,218,989 | B1 | 4/2001 | Schneider et al. | |
| 6,218,992 | B1 | 4/2001 | Sadler et al. | |
| 6,373,439 | B1 | 4/2002 | Zürcher et al. | |
| 6,388,631 | B1 | 5/2002 | Livingston | |
| 6,674,411 | B2 | 1/2004 | Boyle | |
| 6,791,498 | B2 | 9/2004 | Boyle | |
| 6,873,299 | B2 | 3/2005 | Dakeya et al. | |
| 7,069,043 | B2 | 6/2006 | Sawamura | |
| 7,176,845 | B2 | 2/2007 | Fabrega-Sanchez | |
| 7,215,284 | B2 | 5/2007 | Collinson | |
| 7,274,340 | B2 | 9/2007 | Ozden | |
| 7,511,675 | B2 | 3/2009 | Puente | |
| 7,688,276 | B2 | 3/2010 | Quintero | |
| 7,760,146 | B2 | 7/2010 | Ollikainen | |
| 7,764,232 | B2 | 7/2010 | Achour et al. | |
| 7,768,462 | B2 | 8/2010 | Zhang et al. | |
| 7,876,274 | B2 | 1/2011 | Hobson et al. | |
| 7,911,394 | B2 | 3/2011 | Quintero et al. | |
| 8,203,492 | B2 | 6/2012 | Anguera et al. | |
| 8,237,615 | B2 * | 8/2012 | Anguera et al. | 343/702 |
| 8,736,497 | B2 * | 5/2014 | Anguera et al. | 343/702 |
| 8,952,855 | B2 * | 2/2015 | Andujar et al. | 343/725 |
| 8,954,122 | B2 * | 2/2015 | Wilmhoff et al. | 455/575.7 |
| 2002/0149524 | A1 | 10/2002 | Boyle | |
| 2003/0174092 | A1 | 9/2003 | Sullivan et al. | |
| 2004/0058723 | A1 | 3/2004 | Mikkola et al. | |
| 2004/0145527 | A1 | 7/2004 | Mikkola | |
| 2004/0147297 | A1 | 7/2004 | Mikkola et al. | |
| 2004/0171404 | A1 | 9/2004 | Annamaa et al. | |
| 2004/0244187 | A1 | 12/2004 | Annamaa et al. | |
| 2005/0237243 | A1 | 10/2005 | Annamaa et al. | |
| 2006/0135090 | A1 | 6/2006 | Annamaa et al. | |
| 2006/0176225 | A1 | 8/2006 | Annamaa et al. | |
| 2007/0109196 | A1 | 5/2007 | Tang et al. | |
| 2007/0109208 | A1 | 5/2007 | Turner | |
| 2007/0139277 | A1 | 6/2007 | Nissinen et al. | |
| 2007/0146212 | A1 | 6/2007 | Ozden | |
| 2007/0152885 | A1 | 7/2007 | Sorvala | |
| 2007/0152886 | A1 | 7/2007 | Baliarda et al. | |
| 2007/0164913 | A1 | 7/2007 | Sakamoto et al. | |
| 2007/0171131 | A1 | 7/2007 | Sorvala | |
| 2008/0018543 | A1 | 1/2008 | Baliarda et al. | |
| 2008/0030410 | A1 | 2/2008 | Ying | |
| 2008/0042909 | A1 | 2/2008 | Puente et al. | |
| 2008/0088511 | A1 | 4/2008 | Sorvala et al. | |
| 2008/0100514 | A1 | 5/2008 | Abdul-Gaffoor | |
| 2008/0136716 | A1 | 6/2008 | Annamaa et al. | |
| 2008/0303729 | A1 | 12/2008 | Milosavljevic et al. | |
| 2009/0005110 | A1 | 1/2009 | Ozden | |
| 2009/0167625 | A1 | 7/2009 | Puente et al. | |
| 2009/0243943 | A1 | 10/2009 | Mumbru et al. | |
| 2009/0303134 | A1 | 12/2009 | Puente et al. | |
| 2009/0309797 | A1 | 12/2009 | Ozden | |
| 2009/0322619 | A1 | 12/2009 | Ollikainen et al. | |
| 2009/0322623 | A1 | 12/2009 | Xie et al. | |
| 2010/0013720 | A1 | 1/2010 | Sakata et al. | |
| 2010/0073253 | A1 | 3/2010 | Ollikainen | |

FOREIGN PATENT DOCUMENTS

| | | |
|---|---|---|
| EP | 0969375 | 1/2000 |
| EP | 1093098 | 4/2001 |
| EP | 1258054 | 11/2002 |
| EP | 1292042 | 3/2003 |
| EP | 1662604 | 5/2006 |
| EP | 1770824 | 4/2007 |
| ES | 2112163 | 3/1998 |
| FR | 2211766 | 7/1974 |
| GB | 2344969 | 6/2000 |
| KR | 10-0695813 | 3/2007 |
| KR | 10-2008-0080409 | 9/2008 |
| KR | 20090016494 | 2/2009 |
| WO | 94/26000 | 11/1994 |
| WO | 97/06578 | 2/1997 |
| WO | 97/47054 | 12/1997 |
| WO | 99/27608 | 6/1999 |
| WO | 00/76023 | 12/2000 |
| WO | 01/54225 | 7/2001 |
| WO | 02/13306 | 2/2002 |
| WO | 02/063712 | 8/2002 |
| WO | 02/071541 | 9/2002 |
| WO | 2006/020285 | 2/2006 |
| WO | 2006/097496 | 9/2006 |
| WO | 2006097496 | 9/2006 |
| WO | 2006097567 | 9/2006 |
| WO | 2007/039071 | 4/2007 |
| WO | 2007/039668 | 4/2007 |
| WO | 2007/128340 | 11/2007 |
| WO | 2007128340 | 11/2007 |
| WO | 2007/141187 | 12/2007 |
| WO | 2007138157 | 12/2007 |
| WO | 2008/009391 | 1/2008 |
| WO | 2008/045151 | 4/2008 |
| WO | 2008/119699 | 10/2008 |
| WO | 2008119699 | 10/2008 |
| WO | 2010/010529 | 1/2010 |
| WO | 2010015364 | 2/2010 |
| WO | 2010015365 | 2/2010 |

OTHER PUBLICATIONS

Rao , Q. ; Wen , G., Ultra-small cubic folded strip antenna for handset devices, Antennas and Propagation Society (APS), 2008. IEEE International Symposium, Jul. 11, 2008.

Chaudhury , S. K. ; Chaloupka , H. J. ; Ziroff , A., Novel MIMO antennas for mobile terminal, Microwave Conference (EuMC), 38th , 2008. European, Oct. 27, 2008.

Wimer , M. C. , U.S. Appl. No. 10/422,578—Office Action dated on Aug. 23, 2007 , USPTO , Aug. 23, 2007.

Wimer , M. C. , U.S. Appl. No. 10/422,578—Office Action dated on Aug. 24, 2005 , USPTO , Aug. 24, 2005.

Wimer , M. C. , U.S. Appl. No. 10/422,578—Office Action dated on Jan. 26, 2006 , USPTO , Jan. 26, 2006.

Wimer , M. C. , U.S. Appl. No. 10/422,578—Office Action dated on Mar. 12, 2007 , USPTO , Mar. 12, 2007.

Wimer , M. C. , U.S. Appl. No. 10/422,578—Office action dated on Mar. 26, 2008 , USPTO , Mar. 26, 2008.

Wimer , M. C. , U.S. Appl. No. 10/422,578—Office Action dated on Oct. 4, 2004 , USPTO , Oct. 4, 2004.

Nguyen , H. V. , U.S. Appl. No. 12/669,928—Notice of allowance dated on Apr. 12, 2012 , USPTO , Apr. 12, 2012.

Schroeder, W. L. et al., Miniaturization of Mobile Phone Antennas by Utilization of Chassis Mode Resonances, 36th European Microwave Conference, Sep. 2006.

International Search Report in counterpart International Application No. PCT/EP2011/000472, mailed Apr. 8, 2011.

Addison , P. S. , Fractals and Chaos—An illustrated course , Institute of Physics Publising Bristol and Philadelphia , Jan. 1, 1997.

Aguilar , D. ; Anguera , J. ; Puente , C. ; Ribo , M. , Small handset antenna for FM reception , Microwave and Optical Technology Letters , Oct. 1, 2008.

Balanis , Constantine A. , Antenna Theory—Analysis and design—Chapter 4—Linear wire antennas , Hamilton Printing , Jan. 1, 1982 , pp. 133-194.

Bank , M. ; Levin , B. , The development of a cellular phone antenna with small irradiation of human-organism tissues , IEEE Antennas and Propagation Magazine , Jan. 1, 2007 , No. 4 , vol. 49.

Bedair , Adel ; Abdel-Mooty Abdel-Rahman , A. B. , Design and development of high gain wideband microstrip antenna and DGS

(56) References Cited

OTHER PUBLICATIONS filters using numerical experimentation approach , Fakultat Elektrotechnik and Informationstechnik der Otto-von-Guericke-Universitat Magdeburg , Jun. 1, 2006.
Behdad , N. et al. , Slot antenna design for wireless communications systems , EuCAP , Nov. 8, 2007.
Berizzi , F. , Fractal analysis of the signal scattered from the sea surface , Antennas and Propagation, IEEE Transactions on , Feb. 1, 1999 , No. 2 , vol. 47.
Bialkowski , M. et al. , An equivalent circuit model of a radial line planar antenna with coupling probes , Antennas and Propagation Society International Symposium, 2002. IEEE , Jun. 16, 2002.
Boshoff , H. , A fast box counting algorithm for determining the fractal dimension of sampled continuous functions , IEEE , Jan. 1, 1992.
Byndas , A. et al. , Investigations into operation of single—and multi-layer configurations of planar inverted-F antenna , Antennas and Propagation Magazine, IEEE , Aug. 1, 2007 , No. 4 , vol. 49.
Cabedo Fabres , M. , Modal analysis of a radiating slotted PCB for mobile handsets , EuCAP , Nov. 6, 2006.
Cabedo Fabres , M. , Systematic design of antennas using the theory of characteristic modes , Universitat Politécnica de Valencia , Feb. 1, 2007.
Cabedo Fabres , M. et al. , The theory of characteristics modes revisited: a contribution to the design of antennas for modern applications , Antennas and Propagation Magazine, IEEE , Oct. 1, 2007 , No. 5 , vol. 49.
Cabedo Fabres , M. et al. , Wideband radiating ground plane with notches , Antennas and Propagation Society International Symposium, 2005. IEEE , Jul. 3, 2005.
Carver , K. R. et al. , Microstrip antenna technology , Antennas and Propagation, IEEE Transactions on , Jan. 1, 1981 , No. 1 , vol. AP29.
Chen , S. et al. , On the calculation of Fractal features from images , IEEE Transactions on Pattern Analysis and Machine Intelligence , Oct. 1, 1993 , No. 10 , vol. 15.
Collins , B. S. , Improving the RF performance of clamshell handsets , Antenna Technology Small Antennas and Novel Metamaterials, 2006 IEEE International Workshop on , Mar. 6, 2006.
Falconer , K. , Fractal geometry , John Wiley Sons—2nd ed. , Jan. 1, 2003.
Fang , S. ; Shieh , M. , Compact monopole antenna for GSM7DCS/PCS mobile phone , IEEE , Jan. 1, 2005.
Feng , J. , Fractional box-counting approach to fractal dimension estimation , Pattern Recognition, 1996., Proceedings of the 13th International Conference on , Jan. 1, 1996.
Garg , R. et al. , Microstrip antenna design handbook , Artech House , Jan. 1, 2001 , p. 845.
Hall , P.S. ; Gardner , P. et al. , Reconfigurable antenna challenges for future radio systems , Antennas and Propagation, 2009. EUCAPS 2009, 3rd European Conference , Mar. 23, 2009.
Hansen , R. C. , Fundamental limitations in antennas , IEEE Proceedings , Feb. 1, 1981 , p. 170-182 , No. 2 , vol. 69.
Hirose , K. ; Obuse , K. ; Uchikawa , Y. et al , Low-profile circularly polarized radiation elements loops with balanced and unbalanced feeds , IEEE Antennas and Propagation Society International Symposium. AP-S 2008. , Jul. 5, 2008.
Hong , W. et al , Low-profile, multi-element, miniaturized monopole antenna , Antennas and Propagation, IEEE Transactions on , Jan. 1, 2009.
Hsu , Ming-Ren ; Wong , K. , Ceramic chio antenna for WWAN Operation , Asia-Pacific Microwave Conference, 2008. APMC 2008. , Dec. 16, 2008.
Huynh , M. C. , A numerical and experimental investigation of planar inverted-F antennas for wireless communication applications , Virginia Polytechnic Institute and State University , Oct. 19, 2000.
Ilvonen , J. , Isolated antenna structures of mobile terminals , Helsinki University of Technology , Aug. 16, 2009 , p. 98.
Jung , C. ; Lee , M. , Reconfigurable Scan-Beam Single-Arm Spiral Antenna Integrated With RF-MEMS Switches , IEEE Transactions on antennas and propagation , Feb. 1, 2006 , No. 2 , vol. 54.
Kabacik , P. , Potential advantage of using non rectangular ground in small antennas featuring wideband impedance match , Antennas and Propagation Society International Symposium, 2007 IEEE , May 1, 2007.
Kabacik , P. et al. , Broadening the bandwidth in terminal antennas by tuning the coupling between the element and its ground , Antennas and Propagation Society International Symposium, 2005. IEEE , Jul. 3, 2005 , vol. 3.
Kabacik , P. et al. , An application of a narrow slot cut in the ground to improve multi-band operation of a small antenna , Antennas and Propagation Society International Symposium, 2007 IEEE , Jun. 10, 2007.
Kabacik , P. et al. , Broadening the range of resonance tuning in multiband small antennas , IEEE Topical Conference on Wireless Communication Technology , Oct. 15, 2003.
Kabir, S. ; Schoeder , W. ; Chaloupka , H. , Multiple antenna concept based on characteristic modes of mobiles phone chassis , The second european conference on antennas and propagation. EUCAP 2007. , Nov. 11, 2007.
Kildal , P. S. ; Luxey , C. ; Skrivervik , A. K. et al , Report on the state of the art in small terminal antennas: Technologies, requirements and standards , ACE , Dec. 31, 2004 , p. 120.
Kim , Y. ; Lee , S. , Design and fabrication of a planar inverted-f antenna for the wireless Ian in teh 5 GHz band , Microwave and Optical Technology Letters , Sep. 20, 2002 , pp. 469-475 , No. 6 , vol. 34.
Kivekas , O. et al. , Design of high-efficiency antennas for mobile communications devices , University of Technology of Helsinki , Aug. 1, 2005.
Kobayashi , K. , Estimation of 3D fractal dimension of real electrical tree patterns , Proceedings of the 4th International Conference on Properties and Applications of Dielectric Materials , Jul. 1, 1994.
Kraus , John D. , Antennas , McGraw-Hill Book Company , Jan. 1, 1988 , ToC.
Kyro , Mikko ; Mustonen , Maria et al. , Dual-element antenna for DVB-H terminal , Antennas and Propagation Conference, 2008. LAPC 2008. Loughborough , Mar. 17, 2008.
Lin , Chun-I et al. , Printed monopole slot antenna for multiband operation in the mobile phone , Antennas and Propagation Society International Symposium 2006, IEEE , May 1, 2006.
Lindberg , P. et al. , Wideband active and passive antenna solutions for handheld terminals , Acta Universitatis Upsaliensis Uppsala , Jan. 1, 2007.
Martinez , M. , A Review of ACE small terminal antennas activities , ACE , Nov. 10, 2004.
Meinke , H. , Taschenbuch der hochfrequenztechnik—XP002560328 , Springer—Verlag , Jan. 1, 1992 , N 14.
Meinke , H. , Taschenbuch der hochfrequenztechnik—XP002462630 , Springer—Verlag , Jan. 1, 1992.
Meinke , H. ; Gundlach , F. , Taschenbuch der Hochfrequenztechnik: Paperback of high frequency engineering with the collaboration of several experts , Springer-Verlag , Jan. 1, 1968.
Meinke , H. et al. , Taschenbuch der hochfrequenztechnik—Handbook of high frequency technique , Springer-Verlag , Jan. 1, 1968.
Mi , M. Et al , RF Energy harvesting with multiple antennas in the same space , IEEE antennas and propagation magazine , Oct. 1, 2005 , No. 5 , vol. 47.
Minard , P. ; Pintos , J. ; Louzir , A. et al , On-Board integration of compact printed WiFi antennas with existing DECT Antenna System , IEEE Antennas and Propagation Society International Symposium. AP-S 2008. , Jul. 5, 2008.
Morishita , H. et al , Design concept of antennas for small mobile terminals and the future perspective , Antennas and Propagation Magazine, IEEE , Oct. 1, 2002.
Munson , R. , Antenna engineering Handbook—Chapter 7—Microstrip Antennas , Johnson , R. C.—McGraw-Hill—Third Edition , Jan. 1, 1993.
NA , Software—Box counting dimension [electronic] , http://www.sewanee.edu/Physics/PHYSICS123/BOX%20COUNTING%20DIMENSION.html , Apr. 1, 2002.
Neary , D. , Fractal methods in image analysis and coding , Dublin City University—www.redbrick.dcu.ie/*bolsh/thesis/node16.html and *node22.html , Jan. 22, 2001.

(56) References Cited

OTHER PUBLICATIONS

Ng , V. , Diagnosis of melanoma with fractal dimesions , IEEE Tencon , Jan. 1, 1993.
Ollikainen , J. et al. , Design and implementation techniques of wideband mobile communications antennas , Helsinki University of Technology , Nov. 1, 2004.
Park , J. ; Lee , Y. ; Kim , Y. et al , Performance improvement methodology of isolation in a Dual-standby mobile phone by optimizing antenna topology and position , IEEE Antennas and Propagation Society International Symposium. AP-S 2008. , Jul. 5, 2008.
Peitgen, Heinz-Otto; Jürgens, Hartmut; Saupe, Dietmar , Chaos and fractals. New frontiers of science , Springer-Verlag , Feb. 12, 1993 , pp. 212-216 , 387-388.
Penn , A. , Fractal dimension of low-resolution medical images , Engineering in Medicine and Biology Society, 1996. Proceedings of the 18th Annual International Conference of the IEEE , Jan. 1, 1996.
Poutanen , J. , Interaction between mobile terminal antenna and user , Helsinki University of Technology , Sep. 10, 2007.
Poutanen , J. ; Villanen , J. ; Icheln , C. et al , Behaviour of mobile terminal antennas near heman tissue at a wide frequency range , Procedings of Iwat2008, Chiba, Japan. , Jan. 1, 2008.
Pozar , David M. ; Schaubert , Daniel H. , Microstrip antennas. The analysis and design of microstrip antennas and arrays , IEEE Press; Pozar, Schaubert , Jan. 1, 1995 , p. 431.
Rouvier , R. et al. , Fractal analysis of bidimensional profiles and application to electromagnetic scattering from soils , IEEE , Jan. 1, 1996.
Russell , D. A. et al. , Dimension of strange attractors , Physical Review Letters , Oct. 6, 1980 , No. 14 , vol. 45.
Sarkar , N. , An efficient differential box-counting approach to compute fractal dimension of image , IEEEn Transactions on System, Man and Cybernetics , Jan. 3, 1994 , No. 1 , vol. 24.
Schroeder , W. L. , Miniaturization of mobile phone antennas by utilization of chassis mode resonances , 36th European Microwave Conference, 2006 , Sep. 1, 2006.
Serrano , R. et al. , Active balanced feeding for compact wideband antennas , Antennas and Propagation Society International Symposium, 2007 IEEE , Jun. 10, 2007.
Skrivervik , A. K. et al , PCS antenna design—The challenge of miniaturization , Antennas and Propagation Magazine, IEEE , Aug. 1, 2001.
So , P. et al , Box-counting dimension without boxes—Computing D0 from average expansion rates , Physical Review E , Jul. 1, 1999 , No. 1 , vol. 60.
Su , C. , EMC internal patch antenna for UMTS operation in a mobile device , Antennas and Propagation, IEEE Transactions on , Nov. 1, 2005 , No. 11 , vol. 53.
Su , Chih-Ming et al. , User's hand effects on EMC internal GSM/DCS mobile phone antenna , Antennas and Propagation Society International Symposium 2006, IEEE , Jan. 2, 2006.
Talmola , P. , Finding the right frequency: impact of spectrum availability upon the economics of mobile broadcasting , IET Seminar on RF for DVB-H/DMB Mobile Broadcast , Jun. 30, 2006.
Tang , Y. , The application of fractal analysis to feature extraction , IEEE , Jan. 1, 1999.
Vainikainen , P ; Mustonen , M ; Kyrö , M. et al , Recent development of MIMO antennas and their evaluation for small mobile terminals , 17th International Conference on Microwaves, Radar and Wireless Communications. Mikon 2008. , May 19, 2008.
Vainikainen , P. , Design and measurements of small antennas for mobile terminals—Part II , Helsinki University of Technology , Jun. 22, 2006.
Vainikainen , P. , Design and measurements of small antennas for mobile terminals—Part I , Helsinki University of Technology , Jun. 20, 2006.
Villanen , J. , Compact antenna structures for mobile handsets , 58th Vehicular Technology Conference, 2003. VTC 2003—Fall. 2003 IEEE , Oct. 6, 2003.
Villanen , J. , Coupling element based mobile terminal antenna structures , Antennas and Propagation, IEEE Transactions on , Jul. 1, 2006.
Villanen , J. , Miniaturization and evaluation methods of mobile terminal antenna structures , Helsinki University of technology Radio Laboratory Publications , Sep. 3, 2007.
Villanen , J. ; Suvikunnas , P. ; Icheln , C. et al , Performance analysis and design aspects of mobile-terminal multiantenna configurations , IEEE Transactions on vehicular technology. , May 1, 2008 , No. 3 , vol. 57.
Wong , K. ; Huang , C. , Printed Loop Antenna with a Perpendicular Feed for Penta-Band Mobile Phone Application , IEEE Transactions on antennas and propagation , Jul. 1, 2008 , No. 7 , vol. 56.
Wong , Kin-Lu , Planar antennas for wireless communications , Wiley Interscience , Jan. 1, 2003.
Wong , Kin-Lu , Internal GSM/DCS antenna backed by a step-shaped ground plane for a PDA phone , Antennas and Propagation, IEEE Transactions on , Aug. 1, 2006 , No. 8 , vol. 54.
Wong , Kin-Lu , Surface-mountable EMC monopole chip antenna for WLAN operation , Antennas and Propagation, IEEE Transactions on , Apr. 1, 2006 , No. 4 , vol. 54.
Wong , Kin-Lu , Internal shorted patch antenna for UMTS folder-type mobile phone , Antennas and Propagation, IEEE Transactions on , Oct. 1, 2005 , No. 10 , vol. 53.
Wong , Kin-Lu ; Su , Wei-Cheng ; Chang , Fa-Shian , Wideband internal folded planar monopole antenna for UMTS/WiMax folder-type mobile phone , Microwave and Optical Technology Letters , Feb. 2, 2006 , vol. 48.
Wong , Kin-Lu ; Tu , Shu-Yang , Ultra-wideband loop antenna coupled-fed by a monopole feed for penta-band folder-type mobile phone , Microwave and Optical Technology Letters , Oct. 10, 2008 , vol. 50.
Jaggard , D. L. , Rebuttal expert report of Dr. Dwight L. Jaggard (redacted version) , Fractus , Feb. 16, 2011.
Jaggard , D. L. , Expert report of Dwight L. Jaggard (redacted)—expert witness retained by Fractus , Fractus , Feb. 23, 2011.
Long , S. , Rebuttal expert report of Dr. Stuart A. Long (redacted version) , Fractus , Feb. 16, 2011.
NA , Document 0190—Defendant HTC Corporation's First amended answer and counterclaim to plaintiff's amended complaint , Defendants , Oct. 2, 2009.
NA , Letter from Baker Botts to Kenyon & Kenyon LLP, Winstead PC and Howison & Arnott LLP including exhibits. , Defendants—Baker Botts , Oct. 28, 2009.
Van der Peet , H. , EP00909089—Minutes from Oral Proceedings , EPO , Jan. 28, 2005.
Felgel-Farnholz , W. D. , EP00909089—Office Action dated on Feb. 7, 2003 , European Patent Office EPO , Feb. 7, 2003.
Carpintero , F. , EP00909089—Response to Office Action dated on Feb. 7, 2003 , Herrero y Asociados , Aug. 14, 2003.
Weman , E. , EP00909089—Summons to attend oral proceedings , EPO , Oct. 28, 2004.
Carpintero , F. , EP00909089—Written submissions , Herrero y Asociados , Dec. 15, 2004.
Felgel-Farnholz , W. D. , PCT/EP00/00411—International preliminary examination report dated on Aug. 29, 2002—Notification concerning documents transmitted , European Patent Office ( EPO ) , Aug. 29, 2002.
Wittmann-Regis , A. , PCT/EP2009/005578—International Search Report and Written Opinion of the International Searching Authority , International Searching Authority , Feb. 17, 2011.
Weman , E. , PCT/EP2009/005579—International Search Report and Written Opinion of the International Searching Authority , International Searching Authority , May 4, 2010.
Wimer , M. C. , U.S. Appl. No. 10/422,578—Office Action dated on Apr. 7, 2005 , USPTO , Apr. 7, 2005.

* cited by examiner

ANTENNALESS WIRELESS DEVICE COMPRISING ONE OR MORE BODIES

CROSS REFERENCE TO RELATED APPLICATIONS

This application is a continuation of International Application No. PCT/EP2011/000472, filed on Feb. 2, 2011, entitled "Antennaless Wireless Device Comprising One or More Bodies," which claims the benefit of U.S. Provisional Application No. 61/300,573, filed on Feb. 2, 2010, the entire contents of which are hereby incorporated by reference. This application also claims priority under 35 U.S.C. §119(a)-(d) to Application No. EP 10152402.3 filed on Feb. 2, 2010, and to Application No. ES P201031121 filed on Jul. 21, 2010, entitled "Antennaless Wireless Device Comprising One or More Bodies," the entire contents of each of which are hereby incorporated by reference.

FIELD OF THE INVENTION

The present invention relates to the field of wireless handheld devices, and generally to wireless portable devices which require the transmission and reception of electromagnetic wave signals.

BACKGROUND

Wireless handheld or portable devices typically operate one or more cellular communication standards and/or wireless connectivity standards, each standard being allocated in one or more frequency bands, and said frequency bands being contained within one or more regions of the electromagnetic spectrum.

For that purpose, a space within the wireless handheld or portable device is usually dedicated to the integration of a radiating system. The radiating system is, however, expected to be small in order to occupy as little space as possible within the device, which then allows for smaller devices, or for the addition of more specific equipment and functionality into the device. At the same time, it is sometimes required for the radiating system to be flat since this allows for slim devices or in particular, for devices which have two parts that can be shifted or twisted against each other.

Many of the demands for wireless handheld or portable devices also translate to specific demands for the radiating systems thereof.

A typical wireless handheld device must include a radiating system capable of operating in one or more frequency regions with good radioelectric performance (such as for example in terms of input impedance level, impedance bandwidth, gain, efficiency, or radiation pattern). Moreover, the integration of the radiating system within the wireless handheld device must be correct to ensure that the wireless device itself attains a good radioelectric performance (such as for example in terms of radiated power, received power, or sensitivity).

This is even more critical in the case in which the wireless handheld device is a multifunctional wireless device. Commonly-owned patent applications US2008/0018543 and US2009/0243943 describe a multifunctional wireless device, the entire disclosures of which are hereby incorporated by reference in their entireties.

For a good wireless connection, high gain and efficiency are further required. Other more common design demands for radiating systems are the voltage standing wave ratio (VSWR) and the impedance which is supposed to be about 50 ohms.

Other demands for radiating systems for wireless handheld or portable devices are low cost and a low specific absorption rate (SAR).

Furthermore, a radiating system has to be integrated into a device or in other words a wireless handheld or portable device has to be constructed such that an appropriate radiating system may be integrated therein which puts additional constraints by consideration of the mechanical fit, the electrical fit and the assembly fit.

Of further importance, usually, is the robustness of the radiating system which means that the radiating system does not change its properties upon smaller shocks to the device.

A radiating system for a wireless device typically includes a radiating structure comprising an antenna element which operates in combination with a ground plane layer providing a determined radioelectric performance in one or more frequency regions of the electromagnetic spectrum. This is illustrated in FIG. 13, in which it is shown a conventional radiating structure 1300 comprising an antenna element 1301 and a ground plane layer 1302. Typically, the antenna element has a dimension close to an integer multiple of a quarter of the wavelength at a frequency of operation of the radiating structure, so that the antenna element is at resonance at said frequency and a radiation mode is excited on said antenna element.

Although the radiating structure is usually very efficient at the resonance frequency of the antenna element and maintains a similar performance within a frequency range defined around said resonance frequency (or resonance frequencies), outside said frequency range the efficiency and other relevant antenna parameters deteriorate with an increasing distance to said resonance frequency.

Furthermore, the radiating structure operating at a resonance frequency of the antenna element is typically very sensitive to external effects (such as for instance the presence of plastic or dielectric covers that surround the wireless device), to components of the wireless device (such as for instance, but not limited to, a speaker, a microphone, a connector, a display, a shield can, a vibrating module, a battery, or an electronic module or subsystem) placed either in the vicinity of, or even underneath, the antenna element, and/or to the presence of the user of the wireless device.

Any of the above mentioned aspects may alter the current distribution and/or the electromagnetic field distribution of a radiation mode of the antenna element, which usually translates into detuning effects, degradation of the radioelectric performance of the radiating structure and/or the radioelectric performance wireless device, and/or greater interaction with the user (such as an increased level of SAR).

A further problem associated to the integration of the radiating structure, and in particular to the integration of the antenna element, in a wireless device is that the volume dedicated for such an integration has continuously shrunk with the appearance of new smaller and/or thinner form factors for wireless devices, and with the increasing convergence of different functionality in a same wireless device.

Some techniques to miniaturize and/or optimize the multiband behavior of an antenna element have been described in the prior art. However, the radiating structures therein described still rely on exciting a radiation mode on the antenna element.

For example, commonly-owned co-pending patent application US2009/0303134 describes a new family of antennas based on the geometry of space-filling curves. Also, commonly-owned co-pending patent application US2009/0167625 relates to a new family of antennas, referred to as multilevel antennas, formed by an electromagnetic grouping of similar geometrical elements. The entire disclosures of the aforesaid application numbers US2009/0303134 and US2009/0167625 are hereby incorporated by reference.

Some other attempts have focused on antenna elements not requiring a complex geometry while still providing some degree of miniaturization by using an antenna element that is not resonant in the one or more frequency ranges of operation of the wireless device.

For example, WO2007/128340 discloses a wireless portable device comprising a non-resonant antenna element for receiving broadcast signals (such as, for instance, DVB-H, DMB, T-DMB or FM). The wireless portable device further comprises a ground plane layer that is used in combination with said antenna element. Although the antenna element has a first resonance frequency above the frequency range of operation of the wireless device, the antenna element is still the main responsible for the radiation process and for the electromagnetic performance of the wireless device. This is clear from the fact that no radiation mode can be excited on the ground plane layer because the ground plane layer is electrically short at the frequencies of operation (i.e., its dimensions are much smaller than the wavelength).

With such limitations, while the performance of the wireless portable device may be sufficient for reception of electromagnetic wave signals (such as those of a broadcast service), the antenna element could not provide an adequate performance (for example, in terms of input return losses or gain) for a cellular communication standard requiring also the transmission of electromagnetic wave signals.

Commonly-owned patent application WO2008/119699, the entire disclosure of which is incorporated herein by reference, describes a wireless handheld or portable device comprising a radiating system capable of operating in two frequency regions. The radiating system comprises an antenna element having a resonance frequency outside said two frequency regions, and a ground plane layer. In this wireless device, while the ground plane layer contributes to enhance the electromagnetic performance of the radiating system in the two frequency regions of operation, it is still necessary to excite a radiation mode on the antenna element. In fact, the radiating system relies on the relationship between a resonance frequency of the antenna element and a resonance frequency of the ground plane layer in order for the radiating system to operate properly in said two frequency regions.

Some further techniques to enhance the behavior of an antenna element relate to optimizing the geometry of a ground plane layer associated to said antenna element. For example, commonly-owned co-pending patent application U.S. Ser. No. 12/652,412, the entire disclosure of which is incorporated herein by reference, describes a new family of ground plane layers based on the geometry of multilevel structures and/or space-filling curves.

Another limitation of current wireless handheld or portable devices relates to the fact that the design and integration of an antenna element for a radiating structure in a wireless device is typically customized for each device. Different form factors or platforms, or a different distribution of the functional blocks of the device will force to redesign the antenna element and its integration inside the device almost from scratch.

For at least the above reasons, wireless device manufacturers regard the volume dedicated to the integration of the radiating structure, and in particular the antenna element, as being a toll to pay in order to provide wireless capabilities to the handheld or portable device.

SUMMARY

It is an object of the present invention to provide a wireless handheld or portable device comprising one or more bodies (such as for instance but not limited to a mobile phone, a smartphone, a PDA, an MP3 player, a headset, a USB dongle, a laptop computer, a gaming device, a digital camera, a PCMCIA or Cardbus 32 card, or generally a multifunction wireless device) which does not require an antenna element for the transmission and reception of electromagnetic wave signals. Such an antennaless wireless device is yet capable of operation in two or more frequency regions of the electromagnetic spectrum with enhanced radioelectric performance, increased robustness to external effects and neighboring components of the wireless device, and/or reduced interaction with the user.

Another object of the invention relates to a method to enable the operation of a wireless handheld or portable device comprising one or more bodies in two or more frequency regions of the electromagnetic spectrum with enhanced radioelectric performance, increased robustness to external effects and neighboring components of the wireless device, and/or reduced interaction with the user, without requiring the use of an antenna element.

Therefore, a wireless device not requiring an antenna element would be advantageous as it would ease the integration of the radiating structure into the wireless handheld or portable device. The volume freed up by the absence of the antenna element would enable smaller and/or thinner devices, or even to adopt radically new form factors (such as for instance elastic, stretchable and/or foldable devices) which are not feasible today due to the presence of an antenna element. Furthermore, by eliminating precisely the element that requires customization, a standard solution is obtained which only requires minor adjustments to be implemented in different wireless devices.

A wireless handheld or portable device that does not require of an antenna element, yet the wireless device featuring an adequate radioelectric performance in two or more frequency regions of the electromagnetic spectrum would be an advantageous solution. This problem is solved by an antennaless wireless handheld or portable device comprising one or more bodies according to the present invention.

An antennaless wireless handheld or portable device according to the present invention operates one, two, three, four or more cellular communication standards (such as for example GSM 850, GSM 900, GSM 1800, GSM 1900, UMTS, HSDPA, CDMA, W-CDMA, LTE, CDMA2000, TD-SCDMA, etc.), wireless connectivity standards (such as for instance WiFi, IEEE802.11 standards, Bluetooth, ZigBee, UWB, WiMAX, WiBro, or other high-speed standards), and/or broadcast standards (such as for instance FM, DAB, XDARS, SDARS, DVB-H, DMB, T-DMB, or other related digital or analog video and/or audio standards), each standard being allocated in one or more frequency bands, and said frequency bands being contained within two, three or more frequency regions of the electromagnetic spectrum.

In the context of this document, a frequency band preferably refers to a range of frequencies used by a particular cellular communication standard, a wireless connectivity standard or a broadcast standard; while a frequency region preferably refers to a continuum of frequencies of the electromagnetic spectrum. For example, the GSM 1800 standard is allocated in a frequency band from 1710 MHz to 1880 MHz while the GSM 1900 standard is allocated in a frequency band from 1850 MHz to 1990 MHz. A wireless device operating the GSM 1800 and the GSM 1900 standards must have a radiating system capable of operating in a frequency region from 1710 MHz to 1990 MHz. As another example, a wireless device operating the GSM 1800 standard and the UMTS standard (allocated in a frequency band from 1920 MHz to 2170 MHz), must have a radiating system capable of operating in two separate frequency regions.

The antennaless wireless handheld or portable device according to the present invention may have a candy-bar shape, which means that its configuration is given by a single body. It may also have a two-body configuration such as a clamshell, flip-type, swivel-type or slider structure. In some other cases, the device may have a configuration comprising three or more bodies. It may further or additionally have a twist configuration in which a body portion (e.g. with a screen) can be twisted (i.e., rotated around two or more axes of rotation which are preferably not parallel). Also, the present invention makes it possible for radically new form factors, such as for example devices made of elastic, stretchable and/or foldable materials.

For a wireless handheld or portable device which is slim and/or whose configuration comprises two or more bodies, the requirements on maximum height of the antenna element are very stringent, as the maximum thickness of each of the two or more bodies of the device may be limited to 5, 6, 7, 8 or 9 mm. The technology disclosed herein makes it possible for a wireless handheld or portable device comprising one or more bodies to feature an enhanced radioelectric performance without requiring an antenna element, thus solving the space constraint problems associated to such devices.

In the context of the present document a wireless handheld or portable device is considered to be slim if it has a thickness of less than 14 mm, 13 mm, 12 mm, 11 mm, 10 mm, 9 mm or 8 mm.

According to the present invention, an antennaless wireless handheld or portable device advantageously comprises at least five functional blocks: a user interface module, a processing module, a memory module, a communication module and a power management module. The user interface module comprises a display, such as a high resolution LCD, OLED or equivalent, and is an energy consuming module, most of the energy drain coming typically from the backlight use. The user interface module may also comprise a keypad and/or a touchscreen, and/or an embedded stylus pen. The processing module, that is a microprocessor or a CPU, and the associated memory module are also major sources of power consumption. The fourth module responsible of energy consumption is the communication module, an essential part of which is the radiating system. The power management module of the antennaless wireless handheld or portable device includes a source of energy (such as for instance, but not limited to, a battery or a fuel cell) and a power management circuit that manages the energy of the device.

In accordance with the present invention, the communication module of the antennaless wireless handheld or portable device comprising one or more bodies includes a radiating system capable of transmitting and receiving electromagnetic wave signals in at least two frequency regions of the electromagnetic spectrum: a first frequency region and a second frequency region, wherein preferably the highest frequency of the first frequency region is lower than the lowest frequency of the second frequency region. Said radiating system comprises a radiating structure comprising: at least one ground plane layer capable of supporting at least one radiation mode, the at least one ground plane layer including at least one connection point; at least one radiation booster to couple electromagnetic energy from/to the at least one ground plane layer, the/each radiation booster including a connection point; and at least one internal port. The/each internal port is defined between the connection point of the/each radiation booster and one of the at least one connection points of the at least one ground plane layer. The radiating system further comprises a radiofrequency system, and an external port.

In some cases, the radiating system of an antennaless wireless handheld or portable device comprising one or more bodies comprises a radiating structure consisting of: at least one ground plane layer including at least one connection point; at least one radiation booster, the/each radiation booster including a connection point; and at least one internal port.

The radiofrequency system comprises a port connected to each of the at least one internal ports of the radiating structure (i.e., as many ports as there are internal ports in the radiating structure), and a port connected to the external port of the radiating system. Said radiofrequency system modifies the impedance of the radiating structure, providing impedance matching to the radiating system in the at least two frequency regions of operation of the radiating system.

In this text, a port of the radiating structure is referred to as an internal port; while a port of the radiating system is referred to as an external port. In this context, the terms "internal" and "external" when referring to a port are used simply to distinguish a port of the radiating structure from a port of the radiating system, and carry no implication as to whether a port is accessible from the outside or not.

In some examples, the radiating system is capable of operating in at least two, three, four, five or more frequency regions of the electromagnetic spectrum, said frequency regions allowing the allocation of two, three, four, five, six or more frequency bands used in one or more standards of cellular communications, wireless connectivity and/or broadcast services.

In some examples, a frequency region of operation (such as for example the first and/or the second frequency region) of a radiating system is preferably one of the following (or contained within one of the following): 824-960 MHz, 1710-2170 MHz, 2.4-2.5 GHz, 3.4-3.6 GHz, 4.9-5.875 GHz, or 3.1-10.6 GHz.

In some embodiments, the radiating structure comprises two, three, four or more radiation boosters, each of said radiation boosters including a connection point, and each of said connection points defining, together with a connection point of the at least one ground plane layer, an internal port of the radiating structure. Therefore, in some embodiments the radiating structure comprises two, three, four or more radiation boosters, and correspondingly two, three, four or more internal ports.

In some examples, a same connection point of the at least one ground plane layer is used to define at least two, three, or even all, internal ports of the radiating structure.

In some examples, the radiating system comprises a second external port and the radiofrequency system comprises an additional port, said additional port being connected to said second external port. That is, the radiating system features two external ports.

An aspect of the present invention relates to the use of a ground plane layer of the radiating structure as an efficient radiator to provide an enhanced radioelectric performance in two or more frequency regions of operation of the wireless handheld or portable device, eliminating thus the need for an antenna element, and particularly the need for a multiband antenna element. Different radiation modes of a ground plane layer can be advantageously excited when a dimension of said ground plane layer is on the order of, or even larger than, one half of the wavelength corresponding to a frequency of operation of the radiating system.

Therefore, in an antennaless wireless device according to the present invention, no other parts or elements of the wireless handheld or portable device have significant contribution to the radiation process.

In some embodiments, at least one, two, three, or even all, of said radiation modes occur at frequencies advantageously located above (i.e., at a frequency higher than) the first frequency region of operation of the wireless handheld or portable device. In some other embodiments, the frequency of at least one radiation mode of said ground plane layer is within said first frequency region.

In some embodiments, at least one, two, or three, radiation modes of a ground plane layer is/are advantageously located above the second frequency region of operation of the wireless handheld or portable device.

A ground plane rectangle is defined as being the minimum-sized rectangle that encompasses a ground plane layer of the radiating structure. That is, the ground plane rectangle is a rectangle whose sides are tangent to at least one point of said ground plane layer.

In those examples in which a radiating structure comprises two or more ground plane layers, a ground plane rectangle can be defined for each one of them.

In some cases, the ratio between a side of a ground plane rectangle, preferably a long side of said ground plane rectangle, and the free-space wavelength corresponding to the lowest frequency of the first frequency region is advantageously larger than a minimum ratio. Some possible minimum ratios are 0.1, 0.16, 0.2, 0.3, 0.4, 0.5, 0.6, 0.8, 1, 1.2 and 1.4. Said ratio may additionally be smaller than a maximum ratio (i.e., said ratio may be larger than a minimum ratio but smaller than a maximum ratio). Some possible maximum ratios are 0.4, 0.5, 0.6, 0.8, 1, 1.2, 1.4, 1.6, 2, 3, 4, 5, 6, 8 and 10.

Setting a dimension of a ground plane rectangle, preferably the dimension of its long side, relative to said free-space wavelength within these ranges makes it possible for said ground plane layer to support one, two, three or more efficient radiation modes, in which the currents flowing on said ground plane layer are substantially aligned and contribute in phase to the radiation process.

The gain of a radiating structure depends on factors such as its directivity, its radiation efficiency and its input return loss. Both the radiation efficiency and the input return loss of the radiating structure are frequency dependent (even directivity is strictly frequency dependent). A radiating structure is usually very efficient around the frequency of a radiation mode excited in a ground plane layer and maintains a similar radioelectric performance within the frequency range defined by its impedance bandwidth around said frequency. Since the dimensions of a ground plane layer (or those of its ground plane rectangle) are comparable to, or larger than, the wavelength at the frequencies of operation of the wireless device, said radiation mode may be efficient over a broad range of frequencies.

In this text, the expression impedance bandwidth is to be interpreted as referring to a frequency region over which a wireless handheld or portable device and a radiating system comply with certain specifications, depending on the service for which the wireless device is adapted. For example, for a device adapted to transmit and receive signals of cellular communication standards, a radiating system having a relative impedance bandwidth of at least 5% (and more preferably not less than 8%, 10%, 15% or 20%) together with an efficiency of not less than 30% (advantageously not less than 40%, more advantageously not less than 50%) can be preferred. Also, an input return-loss of −3 dB or better within the corresponding frequency region can be preferred.

A wireless handheld or portable device generally comprises one, two, three or more multilayer printed circuit boards (PCBs) on which to carry the electronics. In a preferred embodiment of an antennaless wireless handheld or portable device, a ground plane layer of the radiating structure is at least partially, or completely, contained in at least one of the layers of a multilayer PCB.

In some cases, a wireless handheld or portable device may comprise two, three, four or more ground plane layers. For example a clamshell, flip-type, swivel-type or slider-type wireless device may advantageously comprise two PCBs, each including a ground plane layer.

The/Each radiation booster advantageously couples the electromagnetic energy from the radiofrequency system to the at least one ground plane layer in transmission, and from the at least one ground plane layer to the radiofrequency system in reception. Thereby the radiation booster boosts the radiation or reception of electromagnetic radiation.

In some examples, the/each radiation booster has a maximum size smaller than 1/30, 1/40, 1/50, 1/60, 1/80, 1/100, 1/140 or even 1/180 times the free-space wavelength corresponding to the lowest frequency of the first frequency region of operation of the antennaless wireless handheld or portable device.

In some further examples, at least one (such as for instance, one, two, three or more) radiation booster has a maximum size smaller than 1/30, 1/40, 1/50, 1/60, 1/80, 1/100, 1/140 or even 1/180 times the free-space wavelength corresponding to the lowest frequency of the second frequency region of operation of said device.

An antenna element is said to be small (or miniature) when it can be fitted in a small space compared to a given operating wavelength. More precisely, a radiansphere is usually taken as the reference for classifying whether an antenna element is small. The radiansphere is an imaginary sphere having a radius equal to said operating wavelength divided by two times $\pi$. Therefore, a maximum size of the antenna element must necessarily be not larger than the diameter of said radiansphere (i.e., approximately equal to 1/3 of the free-space operating wavelength) in order to be considered small at said given operating wavelength.

As established theoretically by H. Wheeler and L. J. Chu in the mid 1940's, small antenna elements typically have a high quality factor (Q) which means that most of the power delivered to the antenna element is stored in the vicinity of the antenna element in the form of reactive energy rather than being radiated into space. In other words, an antenna element having a maximum size smaller than 1/3 of the free-space operating wavelength may be regarded as radiating poorly by a skilled-in-the-art person.

The/Each radiation booster for a radiating structure according to the present invention has a maximum size at least smaller than 1/30 of the free-space wavelength corresponding to the lowest frequency of the first frequency region of operation. That is, the/each radiation booster fits in an imaginary sphere having a diameter ten (10) times smaller than the diameter of a radiansphere at said same operating wavelength.

Setting the dimensions of the/each radiation booster to such small values is advantageous because the radiation booster substantially behaves as a non-radiating element for all the frequencies of the first and second frequency regions, thus substantially reducing the loss of energy into free space due to undesired radiation effects of the radiation booster, and consequently enhancing the transfer of energy between the radiation booster and the at least one ground plane layer. Therefore, the skilled-in-the-art person could not possibly regard the/each radiation booster as being an antenna element.

The maximum size of a radiation booster is preferably defined by the largest dimension of a booster box that completely encloses said radiation booster, and in which the radiation booster is inscribed.

More specifically, a booster box for a radiation booster is defined as being the minimum-sized parallelepiped of square or rectangular faces that completely encloses the radiation booster and wherein each one of the faces of said minimum-sized parallelepiped is tangent to at least a point of said radiation booster. Moreover, each possible pair of faces of said minimum-size parallelepiped sharing an edge forms an inner angle of 90°.

In those cases in which the radiating structure comprises more than one radiation booster, a different booster box is defined for each of them.

In some examples, one of the dimensions of a booster box can be substantially smaller than any of the other two dimensions, or even be close to zero. In such cases, said booster box collapses to a practically two-dimensional entity. The term dimension preferably refers to an edge between two faces of said parallelepiped.

Additionally, in some of these examples the/each radiation booster has a maximum size larger than $1/1400$, $1/700$, $1/350$, $1/250$, $1/180$, $1/140$ or $1/120$ times the free-space wavelength corresponding to the lowest frequency of said first frequency region. Therefore, in some examples the/each radiation booster has a maximum size advantageously smaller than a first fraction of the free-space wavelength corresponding to the lowest frequency of the first frequency region but larger than a second fraction of said free-space wavelength.

Furthermore, in some of these examples, at least one, two, or three radiation boosters have a maximum size larger than $1/1400$, $1/700$, $1/350$, $1/175$, $1/120$, or $1/90$ times the free-space wavelength corresponding to the lowest frequency of the second frequency region of operation of the antennaless wireless handheld or portable device.

Setting the dimensions of a radiation booster to be above some certain minimum value is advantageous to obtain a higher level of the real part of the input impedance of the radiating structure (measured at the internal port of the radiating structure associated to said radiation booster when disconnected from the radiofrequency system) and in this way enhance the transfer of energy between said radiation booster and the at least one ground plane layer.

In some other cases, preferably in combination with the above feature of an upper bound for the maximum size of a radiation booster although not always required, to reduce even further the losses in a radiation booster due to residual radiation effects, said radiation booster is designed so that the radiating structure has at the internal port of said radiating structure associated to said radiation booster, when disconnected from the radiofrequency system, a first resonance frequency at a frequency much higher than the frequencies of the first frequency region of operation. Moreover, said first resonance frequency may preferably be also much higher than the frequencies of the second frequency region of operation. In some examples, a radiation booster has a dimension substantially close to a quarter of the wavelength corresponding to the first resonance frequency at the internal port of the radiating structure associated to said radiation booster.

In a preferred example, the radiating structure features at the/each internal port, when disconnected from the radiofrequency system, a first resonance frequency located above (i.e., higher than) the first frequency region of operation of the radiating system.

In some examples, for at least some of, or even all, the internal ports of the radiating structure, the ratio between the first resonance frequency at a given internal port of the radiating structure when disconnected from the radiofrequency system and the highest frequency of said first frequency region is preferably larger than a certain minimum ratio. Some possible minimum ratios are 3.0, 3.4, 3.8, 4.0, 4.2, 4.4, 4.6, 4.8, 5.0, 5.2, 5.4, 5.6, 5.8, 6.0, 6.2, 6.6 or 7.0.

In the context of this document, a resonance frequency associated to an internal port of the radiating structure preferably refers to a frequency at which the input impedance measured at said internal port of the radiating structure, when disconnected from the radiofrequency system, has an imaginary part equal to zero.

With the/each radiation booster being so small, and with the radiating structure including said radiation booster or boosters operating in a frequency range much lower than the first resonance frequency at the/each internal port associated to the/each radiation booster, the input impedance of the radiating structure (measured at the/each internal port when the radiofrequency system is disconnected) features an important reactive component (either capacitive or inductive) within the range of frequencies of the first and/or second frequency region of operation. That is, the input impedance of the radiating structure at the/each internal port when disconnected from the radiofrequency system has an imaginary part not equal to zero for any frequency of the first and/or second frequency region.

In some examples, the first resonance frequency at an internal port is at the same time located below (i.e., at a frequency lower than) the second frequency region of operation of the radiating system. Hence, the first resonance frequency at said internal port is located above the first frequency region but below the second frequency region.

In some cases, the first resonance frequency at the/each internal port of the radiating structure is also above the second frequency region of operation of the radiating system.

In some further examples, the first resonance frequency at an internal port of the radiating structure is located above a third frequency region of operation of the radiating system, said third frequency region having a lowest frequency higher than the highest frequency of the second frequency region of operation of said radiating system.

In some examples the at least one radiation booster is substantially planar defining a two-dimensional structure, while in other cases the at least one radiation booster is a three-dimensional structure that occupies a volume. In particular, in some examples, the smallest dimension of a booster box is not smaller than a 70%, an 80% or even a 90% of the largest dimension of said booster box, defining a volumetric geometry. Radiation boosters having a volumetric geometric may be advantageous to enhance the radioelectric performance of the radiating structure, particularly in those cases in which the maximum size of the radiation booster is very small relative to the free-space wavelength corresponding to the lowest frequency of the first and/or second frequency region.

Moreover, providing a radiation booster with a volumetric geometry can be advantageous to reduce the other two dimensions of its radiator box, leading to a very compact solution. Therefore, in some examples in which the at least one radiation booster has a volumetric geometry, it is preferred to set a ratio between the first resonance frequency associated to the/each internal port of the radiating structure when disconnected from the radiofrequency system and the highest frequency of the first frequency region above 4.8, or even above 5.4.

In some advantageous examples, the radiating structure includes a first radiation booster having a volumetric geometry and a second radiation booster being substantially planar. In such examples, said first radiation booster may preferably excite a radiation mode on a ground plane layer responsible for the operation of the radiating system in the first frequency region.

In a preferred embodiment, the at least one radiation booster comprises a conductive part. In some cases said conductive part may take the form of, for instance but not limited to, a conducting strip comprising one or more segments, a polygonal shape (including for instance triangles, squares, rectangles, hexagons, or even circles or ellipses as limit cases of polygons with a large number of edges), a polyhedral shape comprising a plurality of faces (including also cylinders or spheres as limit cases of polyhedrons with a large number of faces), or a combination thereof.

In some examples, the connection point of the at least one radiation booster is advantageously located substantially close to an end, or to a corner, of said conductive part.

In a preferred example of the present invention, a major portion of the at least one radiation booster (such as at least a 50%, or a 60%, or a 70%, or an 80% of the surface of said radiation booster) is placed on one or more planes substantially parallel to a ground plane layer. In the context of this document, two surfaces are considered to be substantially parallel if the smallest angle between a first line normal to one of the two surfaces and a second line normal to the other of the two surfaces is not larger than 30°, and preferably not larger than 20°, or even more preferably not larger than 10°.

In some examples, said one or more planes substantially parallel to said ground plane layer and containing a major portion of a radiation booster of the radiating structure are preferably at a height with respect to said ground plane layer not larger than a 2% of the free-space wavelength corresponding to the lowest frequency of the first frequency region of operation of the radiating system. In some cases, said height is smaller than 7 mm, preferably smaller than 5 mm, and more preferably smaller than 3 mm.

In some embodiments, the at least one radiation booster is substantially coplanar to a ground plane layer. Furthermore, in some cases the at least one radiation booster is advantageously embedded in the same PCB as the one containing a ground plane layer, which results in a radiating structure having a very low profile.

In some cases at least two, three, four, or even all, radiation boosters are substantially coplanar to each other, and preferably also substantially coplanar to a ground plane layer.

In a preferred example the radiating structure is arranged within the wireless handheld or portable device in such a manner that there is no ground plane in the orthogonal projection of a radiation booster onto the plane containing one of the at least one ground plane layer. In some examples there is some overlapping between the projection of a radiation booster and a ground plane layer. In some embodiments less than a 10%, a 20%, a 30%, a 40%, a 50%, a 60% or even a 70% of the area of the projection of a radiation booster overlaps said ground plane layer. Yet in some other examples, the projection of a radiation booster onto said ground plane layer completely overlaps the ground plane layer.

In some cases it is advantageous to protrude at least a portion of the orthogonal projection of a radiation booster beyond a ground plane layer, or alternatively remove ground plane from at least a portion of the projection of a radiation booster, in order to adjust the levels of impedance and to enhance the impedance bandwidth of the radiating structure. This aspect is particularly suitable for those examples when the volume for the integration of the radiating structure has a small height, as it is the case in particular for slim wireless handheld or portable devices.

In some examples, at least one, two, three, or even all, radiation boosters are preferably located substantially close to an edge of a ground plane layer, preferably said edge being in common with a side of the ground plane rectangle associated to said ground plane layer. In some examples, at least one radiation booster is more preferably located substantially close to an end of said edge or to the middle point of said edge.

In some embodiments said edge is preferably an edge of a substantially rectangular or elongated ground plane layer.

In an example, a radiation booster is located preferably substantially close to a short side of a ground plane rectangle, and more preferably substantially close to an end of said short side or to the middle point of said short side. Such a placement for a radiation booster with respect to said ground plane layer is particularly advantageous when the radiating structure features at the internal port associated to said radiation booster, when the radiofrequency system is disconnected, an input impedance having a capacitive component for the frequencies of the first and second frequency regions of operation.

In another example, a radiation booster is located preferably substantially close to a long side of a ground plane rectangle, and more preferably substantially close to an end of said long side or to the middle point of said long side. Such a placement for a radiation booster is particularly advantageous when the radiating structure features at the internal port associated to said radiation booster, when the radiofrequency system is disconnected, an input impedance having an inductive component for the frequencies of said first and second frequency regions.

In some other examples, at least one radiation booster is advantageously located substantially close to a corner of a ground plane layer, preferably said corner being in common with a corner of the ground plane rectangle associated to said ground plane layer.

In the context of this document, two points are substantially close to each other if the distance between them is less than 5% (more preferably less than 3%, 2%, 1% or 0.5%) of the free-space wavelength corresponding to the lowest frequency of operation of the radiating system. In the same way, two linear dimensions are substantially close to each other if they differ in less than 5% (more preferably less than 3%, 2%, 1% or 0.5%) of said free-space wavelength.

In some examples, a radiating structure for a radiating system of a wireless handheld or portable device comprises a first radiation booster, a second radiation booster and a ground plane layer. The radiating structure therefore comprises two internal ports: a first internal port being defined between a connection point of the first radiation booster and the at least one connection point of said ground plane layer; and a second internal port being defined between a connection point of the second radiation booster and said at least one connection point of said ground plane layer.

In an advantageous example, the first radiation booster is substantially close to a first corner of a ground plane layer and the second radiation booster is substantially close to a second corner of said ground plane layer (said second corner not being the same as said first corner). The first and second corners are preferably in common with two corners of the ground plane rectangle associated to said ground plane layer and, more preferably, said two corners are at opposite ends of a short side of said ground plane rectangle. Such a placement of the radiation boosters may be particularly interesting when it is necessary to achieve higher isolation between the two internal ports of the radiating structure.

In another advantageous example, and in order to facilitate the interconnection of the radiation boosters to the radiofrequency system, said first and second radiation booster are substantially close to a first corner of a ground plane layer, the first corner being preferably in common with a corner of the ground plane rectangle associated to said ground plane layer. In this example, preferably, the first and the second radiation boosters are such that the first internal port, when the radiofrequency system is disconnected, features an input impedance having an inductive component for the frequencies of the first and second frequency regions, and the second internal port, also when the radiofrequency system is disconnected, features an input impedance having a capacitive component for the frequencies of the first and second frequency regions.

In yet another advantageous embodiment, the first radiation booster is located substantially close to a short edge of a ground plane layer and the second radiation booster is located substantially close to a long edge of said ground plane layer. Preferably, said short edge and said long edge are in common with a short side and a long side respectively of the ground plane rectangle associated to said ground plane layer and meet at a corner. Such a choice of the placement of the first and second radiation boosters may be particularly advantageous to excite radiation modes on said ground plane layer having substantially orthogonal polarizations and/or to achieve an increased level of isolation between the two internal ports of the radiating structure.

In some examples, the at least one connection point of the at least one ground plane layer is located advantageously close to the connection point of one of the at least one radiation boosters in order to facilitate the interconnection of the radiofrequency system with the radiating structure. Therefore, those locations specified above as being preferred for the placement of a radiation booster are also advantageous for the location of the at least one connection point of the at least one ground plane layer. Therefore, in some examples said at least one connection point is located substantially close to an edge of one of the at least one ground plane layer, preferably an edge in common with a side of the ground plane rectangle associated to said ground plane layer, or substantially close to a corner of said ground plane layer, preferably said corner being in common with a corner of said ground plane rectangle. Such an election of the position of the at least one connection point of the at least one ground plane layer may be advantageous to provide a longer path to the electrical currents flowing on the at least one ground plane layer, lowering the frequency of one or more radiation modes of the at least one ground plane layer.

In some embodiments, the radiofrequency system comprises at least one matching network (such as for instance, one, two, three, four or more matching networks) to transform the input impedance of the radiating structure, providing impedance matching to the radiating system in at least the first and second frequency regions of operation of the radiating system.

In a preferred example, the radiofrequency system comprises as many matching networks as there are radiation boosters (and, consequently, internal ports) in the radiating structure.

In another preferred example, the radiofrequency system comprises as many matching networks as there are frequency regions of operation of the radiating system. That is, in a radiating system operating for example in a first and in a second frequency region, its radiofrequency system may advantageously comprise a first matching network to provide impedance matching to the radiating system in said first frequency region and a second matching network to provide impedance matching to the radiating system in said second frequency region.

The/each matching network can comprise a single stage or a plurality of stages. In some examples, the/each matching network comprises at least two, at least three, at least four, at least five, at least six, at least seven, at least eight or more stages.

A stage comprises one or more circuit components (such as for example but not limited to inductors, capacitors, resistors, jumpers, short-circuits, switches, delay lines, resonators, or other reactive or resistive components). In some cases, a stage has a substantially inductive behavior in the frequency regions of operation of the radiating system, while another stage has a substantially capacitive behavior in said frequency regions, and yet a third one may have a substantially resistive behavior in said frequency regions.

A stage can be connected in series or in parallel to other stages and/or to one of the at least one port of the radiofrequency system.

In some examples, the at least one matching network alternates stages connected in series (i.e., cascaded) with stages connected in parallel (i.e., shunted), forming a ladder structure. In some cases, a matching network comprising two stages forms an L-shaped structure (i.e., series—parallel or parallel—series). In some other cases, a matching network comprising three stages forms either a pi-shaped structure (i.e., parallel—series—parallel) or a T-shaped structure (i.e., series—parallel—series).

In some examples, the at least one matching network alternates stages having a substantially inductive behavior, with stages having a substantially capacitive behavior.

In an example, a stage may substantially behave as a resonant circuit (such as, for instance, a parallel LC resonant circuit or a series LC resonant circuit) in at least one frequency region of operation of the radiating system (such as for instance in the first or the second frequency region). The use of stages having a resonant circuit behavior allows one part of a given matching network be effectively connected to another part of said matching network for a given range of frequencies, or in a given frequency region, and be effectively disabled for another range of frequencies, or in another frequency region.

In an example, the at least one matching network comprises at least one active circuit component (such as for instance, but not limited to, a transistor, a diode, a MEMS device, a relay, or an amplifier) in at least one stage.

In some embodiments, the/each matching network preferably includes a reactance cancellation circuit comprising one or more stages, with one of said one or more stages being connected to a port of the radiofrequency system, said port being for interconnection with an internal port of the radiating structure.

In the context of this document, reactance cancellation preferably refers to compensating the imaginary part of the input impedance at an internal port of the radiating structure when disconnected from the radiofrequency system so that the input impedance of the radiating system at an external port has an imaginary part substantially close to zero for a frequency preferably within a frequency region of operation (such as for instance, the first or the second frequency regions). In some less preferred examples, said frequency may also be higher than the highest frequency of said frequency region (although preferably not higher than 1.1, 1.2, 1.3 or 1.4 times said highest frequency) or lower than the lowest frequency of said frequency region (although preferably not lower than 0.9, 0.8 or 0.7 times said lowest frequency). Moreover, the imaginary part of an impedance is considered to be substantially close to zero if it is not larger (in absolute value) than 15 Ohms, and preferably not larger than 10 Ohms, and more preferably not larger than 5 Ohms.

In a preferred embodiment, the radiating structure features at a first internal port when the radiofrequency system is disconnected from said first internal port an input impedance having a capacitive component for the frequencies of the first and second frequency regions of operation. In that embodiment, a matching network interconnected to said first internal port (via a port of the radiofrequency system) includes a reactance cancellation circuit that comprises a first stage having a substantially inductive behavior for all the frequencies of the first and second frequency regions of operation of the radiating system. More preferably, said first stage comprises an inductor. In some cases, said inductor may be a lumped inductor. Said first stage is advantageously connected in series with said port of the radiofrequency system that is interconnected to said first internal port of the radiating structure of a radiating system.

In another preferred embodiment, the radiating structure features at a first internal port when the radiofrequency system is disconnected from said first internal port an input impedance having an inductive component for the frequencies of the first and second frequency regions of operation. In that embodiment, a matching network interconnected to said first internal port (via a port of the radiofrequency system) includes a reactance cancellation circuit that comprises a first stage and a second stage forming an L-shaped structure, with said first stage being connected in parallel and said second stage being connected in series. Each of the first and the second stage has a substantially capacitive behavior for all the frequencies of the first and second frequency regions of operation of the radiating system. More preferably, said first stage and said second stage comprise each a capacitor. In some cases, said capacitor may be a lumped capacitor. Said first stage is advantageously connected in parallel with said port of the radiofrequency system that is interconnected to said first internal port of the radiating structure of a radiating system, while said second stage is connected to said first stage.

In yet another preferred embodiment, the radiating structure comprises a first internal port that features, when said first internal port is disconnected from the radiofrequency system, an input impedance having a capacitive component for the frequencies of the first and second frequency regions of operation and a second internal port that features (also when said second internal port is disconnected from the radiofrequency system) an input impedance having an inductive component for the frequencies of the first and second frequency regions of operation.

In some embodiments, the at least one matching network may further comprise a broadband matching circuit, said broadband matching circuit being preferably connected in cascade to the reactance cancellation circuit. With a broadband matching circuit, the impedance bandwidth of the radiating structure may be advantageously increased. This may be particularly interesting for those cases in which the relative bandwidth of the first and/or second frequency region is large.

In a preferred embodiment, the broadband matching circuit comprises a stage that substantially behaves as a resonant circuit (preferably as a parallel LC resonant circuit or as a series LC resonant circuit) in one of the at least two frequency regions of operation of the radiating system.

In some examples, the at least one matching network may further comprise in addition to the reactance cancellation circuit and/or the broadband matching circuit, a fine tuning circuit to correct small deviations of the input impedance of the radiating system with respect to some given target specifications.

In a preferred example, a matching network comprises: a reactance cancellation circuit connected to a first port of the radiofrequency system, said first port being connected to an internal port of the radiating structure; and a fine tuning circuit connected to a second port of the radiofrequency system, said second port being connected to an external port of the radiating system. In an example, said matching network further comprises a broadband matching circuit operationally connected in cascade between the reactance cancellation circuit and the fine tuning circuit. In another example, said matching network does not comprise a broadband matching circuit and the reactance cancellation circuit is connected in cascade directly to the fine tuning circuit.

In some examples, at least some circuit components in the stages of the at least one matching network are discrete lumped components (such as for instance SMT components), while in some other examples all the circuit components of the at least one matching network are discrete lumped components. In some examples, at least some circuit components in the stages of the at least one matching network are distributed components (such as for instance a transmission line printed or embedded in a PCB containing a ground plane layer of the radiating structure), while in some other examples all the circuit components of the at least one matching network are distributed components.

In some examples, at least some, or even all, circuit components in the stages of the at least one matching network may be integrated into an integrated circuit, such as for instance a CMOS integrated circuit or a hybrid integrated circuit.

In some embodiments, the radiofrequency system may comprise a frequency selective element such as a diplexer or a bank of filters to separate, or to combine, the electrical signals of the different frequency regions of operation of the radiating system.

In an example, the radiofrequency system comprises a first diplexer to separate the electrical signals of the first and second frequency regions of operation of the radiating system, a first matching network to provide impedance matching in said first frequency region, a second matching network to provide impedance matching in said second frequency region, and a second diplexer to recombine the electrical signals of said first and second frequency regions.

Alternatively, a diplexer can be replaced by a bank of band-pass filters and a combiner/splitter. Also, a diplexer and a bank of band-pass filters may be used in the radiofrequency system. Preferably, there are as many band-pass filters in the bank of band-pass filters as there are frequency regions of operation of the radiating system. Each one of the band-pass filters is designed to introduce low insertion loss in a different frequency region and to present high impedance to the combiner/splitter in the other frequency regions. The combiner/splitter combines (or splits) the electrical signals of the different frequency regions of operation of the radiating system.

In the context of this document high impedance in a given frequency region preferably refers to impedance having a modulus not smaller than 150 Ohms, 200 Ohms, 300 Ohms, 500 Ohms or even 1000 Ohms for any frequency within said frequency region, and more preferably being substantially reactive (i.e., having a real part substantially close to zero) within said given frequency region.

In some examples, one, two, three or even all the stages of the at least one matching network may contribute to more than one functionality of said at least one matching network. A given stage may for instance contribute to two or more of the following functionalities from the group comprising: reactance cancellation, impedance transformation (preferably, transformation of the real part of said impedance), broadband matching and fine tuning matching. In other words, a same stage of the at least one matching network may advantageously belong to two or three of the following circuits: reactance cancellation circuit, broadband matching circuit and fine tuning circuit. Using a same stage of the at least one matching network for several purposes may be advantageous in reducing the number of stages and/or circuit components required for the at least one matching network of a radiofrequency system, reducing the real estate requirements on the PCB of the antennaless wireless handheld or portable device in which the radiating system is integrated.

In other examples, each stage of the at least one matching network serves only to one functionality within the matching network. Such a choice may be preferred when low-end circuit components, having for instance a worse tolerance behavior, a more pronounced thermal dependence, and/or a lower quality factor, are used to implement said at least one matching network.

In some examples of the present invention, an antennaless wireless handheld or portable device comprises a first body, a second body and a hinge means mechanically connecting the two bodies together, the hinge means allowing at least one of the two bodies to pivotally move around an axis so that the wireless device can be switched between a closed position in which one of the two bodies is substantially arranged on top of the other and an open position in which the first body extends away from the hinge means along a first direction and the second body extends away from the hinge means along a second direction different from the first direction.

In these examples, the wireless device advantageously comprises a communication module including a radiating system capable of transmitting and receiving electromagnetic wave signals in a first frequency region and in a second frequency region, wherein the highest frequency of the first frequency region is lower than the lowest frequency of the second frequency region.

Said radiating system comprises a radiating structure which, in turn, comprises (or even in some cases consists of): a first ground plane layer capable of supporting at least one radiation mode, the first ground plane layer being contained within the first body of the wireless device and including at least one connection point; a second ground plane layer, the second ground plane layer being contained within the second body of the wireless device; a ground connection means electrically connecting the first ground plane layer and the second ground plane layer; at least one radiation booster to couple electromagnetic energy from/to the first ground plane layer, the/each radiation booster including a connection point; and at least one internal port. The radiating system further comprises a radiofrequency system, and an external port.

According to an aspect of the present invention, the second ground plane layer advantageously establishes electrical contact with one or more of the at least one radiation booster when the wireless device is in the open position but not when the wireless device is in the closed position.

When the wireless device is in the closed position the input impedance of the radiating structure at the/each internal port when disconnected from the radiofrequency system has an imaginary part not equal to zero for any frequency of the first frequency region.

In these examples, the radiofrequency system modifies the impedance of the radiating structure, providing impedance matching to the radiating system in the at least two frequency regions of operation of the radiating system both when the wireless device is in the closed position and in the open position.

By establishing electrical contact between the second ground plane layer and at least one radiation booster of the radiating structure when the wireless device is in the open position, the second ground plane layer may advantageously be electrically driven through said radiation booster or boosters and behave as a radiating element, which in cooperation with the first ground plane layer, can provide operability to the radiating system in the first frequency region and/or the second frequency region.

In other words, in the open position the second ground plane layer acts as the radiating arm of a monopole antenna, while the first ground plane layer is a ground plane layer of said monopole antenna.

On the other hand, in the closed position the second ground plane layer does not establish electrical contact with any radiation booster. In this way, the operation of the radiation booster or boosters of the radiating structure is not perturbed. That is, in the closed position the at least one radiation booster serves its function of coupling electromagnetic energy to/from the at least one ground plane layer, preferably the first ground plane layer.

The use of the second ground plane layer as a radiating element when the wireless device is in the open position may complement the operation of the radiation booster or boosters, or alternatively may replace the operation of the radiation booster or boosters when the wireless device is in said open position.

Therefore, in an embodiment, when the wireless device is in the open position a radiation booster couples electromagnetic energy to/from the first ground plane layer in order to excite a radiation mode, while at the same time another radiation booster drives the second ground plane layer so as to behave as a radiating element.

Alternatively, in another embodiment, when the wireless device is in the open position the radiation booster or boosters are only used to drive the second ground plane layer and not to couple electromagnetic energy to/from the first ground plane layer.

The ground connection means connects electrically the first ground plane layer and the second ground plane layer of the two-body wireless device. Such a ground connection means is typically used to balance the ground potential between the two ground plane layers.

In some examples, the ground connection means comprises a conductive strip (such as for example a flexible conductive film) or a conductive wire or cable. Moreover, in some cases, the ground connection means may comprise two, three or more conductive strips or wires. Furthermore, the conductive strip or the conductive wire or cable is preferably flexible.

In some examples, the ground connection means is advantageously located proximate to the hinge means of the wireless device and connects electrically a short edge of the first ground plane layer with a short edge of the second ground plane layer. More preferably, said short edges of the first and second ground plane layers are in common with short sides of the ground plane rectangles associated to said first and second ground plane layers.

In an embodiment the ground connection means connects to the short edge of the first ground plane layer, or to the short edge of the second ground plane layer, substantially close to the center of said edge; while in another embodiment the ground connection means connects to the short edge of the first ground plane layer, or to the short edge of the second ground plane layer, substantially close to an end of said edge.

In yet another embodiment, the ground connection means comprises two conductive strips or wires that connect the two ends of a short edge of the first ground plane layer with the two ends of a short edge of the second ground plane layer.

In these examples, the at least one radiation booster is advantageously located substantially close to the hinge means, so that when the wireless device is in the open position the at least one radiation booster lies between the first ground plane layer and the second ground plane layer. In this way, one, two, three or even more radiation boosters can make electrical contact with the second ground plane layer.

In some examples, a radiation booster is substantially close to a short edge of the first ground plane layer, said short edge being preferably the same edge to which the ground connection means is connected. In an example, said radiation booster is substantially close to an end of the said short edge, while in another example said radiation booster is substantially close to the center of said short edge.

In a preferred example, the radiating structure comprises two radiation boosters, each radiation booster being substantially close to one end of two opposite ends of a short edge of the first ground plane layer, wherein said short edge is proximate to the hinge means and is preferably the same edge to which the ground connection means is connected.

In a preferred example, the ground connection means comprises choking means (such as for instance a coil or an inductor) to effectively disconnect the second ground plane layer from the first ground plane layer for the frequencies of the first and second frequency ranges.

By providing a choking means in series to the conductive strip or wire that connects the two ground plane layers, the ground connection means exhibits low impedance at frequencies much lower than those of the first frequency range and high impedance at the frequencies of operation of the wireless device. As a result, the balancing of the DC ground potential between the two ground plane layers is preserved, but the effect of the second ground plane layer as radiating element when the wireless device is in the open position is enhanced.

The radiofrequency system modifies the impedance of the radiating structure to provide impedance matching to the radiating system in the at least two frequency regions of operation. Such impedance matching is to be obtained both when the wireless device is in the closed position and when it is in the open position.

Since the input impedance of the radiating structure at the/each internal port when disconnected from the radiofrequency system may be different depending on whether the wireless device is in the closed position or in the open position, in some examples the radiofrequency system comprises a first set of matching networks that provide impedance matching when the wireless device is in the closed position and a second set of matching networks that provide impedance matching when the wireless device is in the open position. In these cases, the radiofrequency system further comprises switching means (such as for instance one or more switches) to select which one of the first and second set of matching networks is operatively connected to the radiating structure.

In an example, the switching means are mechanically activated when the user switches the two bodies of the wireless device between the closed position and the open position.

BRIEF DESCRIPTION OF THE DRAWINGS

Embodiments of the invention are shown in the enclosed figures. Herein shows.

DETAILED DESCRIPTION

Further characteristics and advantages of the invention will become apparent in view of the detailed description of some preferred embodiments which follows. Said detailed description of some preferred embodiments of the invention is given for purposes of illustration only and in no way is meant as a definition of the limits of the invention, made with reference to the accompanying figures.

Figure 1A:
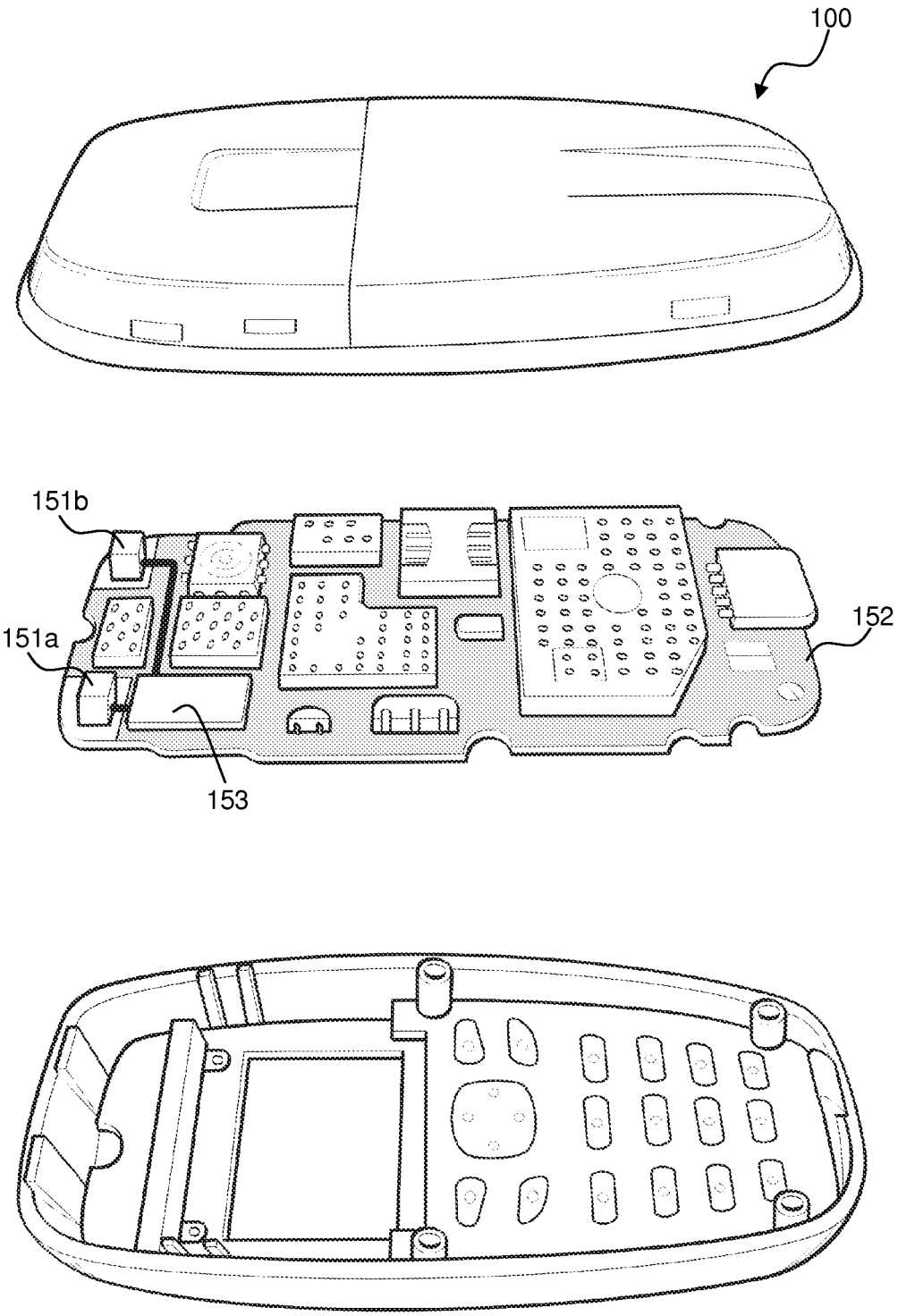
FIG. 1—(a) Example of an antennaless wireless handheld or portable device including a radiating system according to the present invention; and (b) Block diagram of an antennaless wireless handheld or portable device illustrating the basic functional blocks thereof.

FIG. 1 shows an illustrative example of an antennaless wireless handheld or portable device 100 capable of multiband operation according to the present invention. In FIG. 1*a*, there is shown an exploded perspective view of the antennaless wireless handheld or portable device 100 comprising a radiating structure that includes a first radiation booster 151*a*, a second radiation booster 151*b* and a ground plane layer 152 (which could be included in a layer of a multilayer PCB). In this example, the wireless device comprises a single body, and the ground plane layer 152 is contained within said body. The antennaless wireless handheld or portable device 100 also comprises a radiofrequency system 153, which is interconnected with said radiating structure.

Figure 1B:
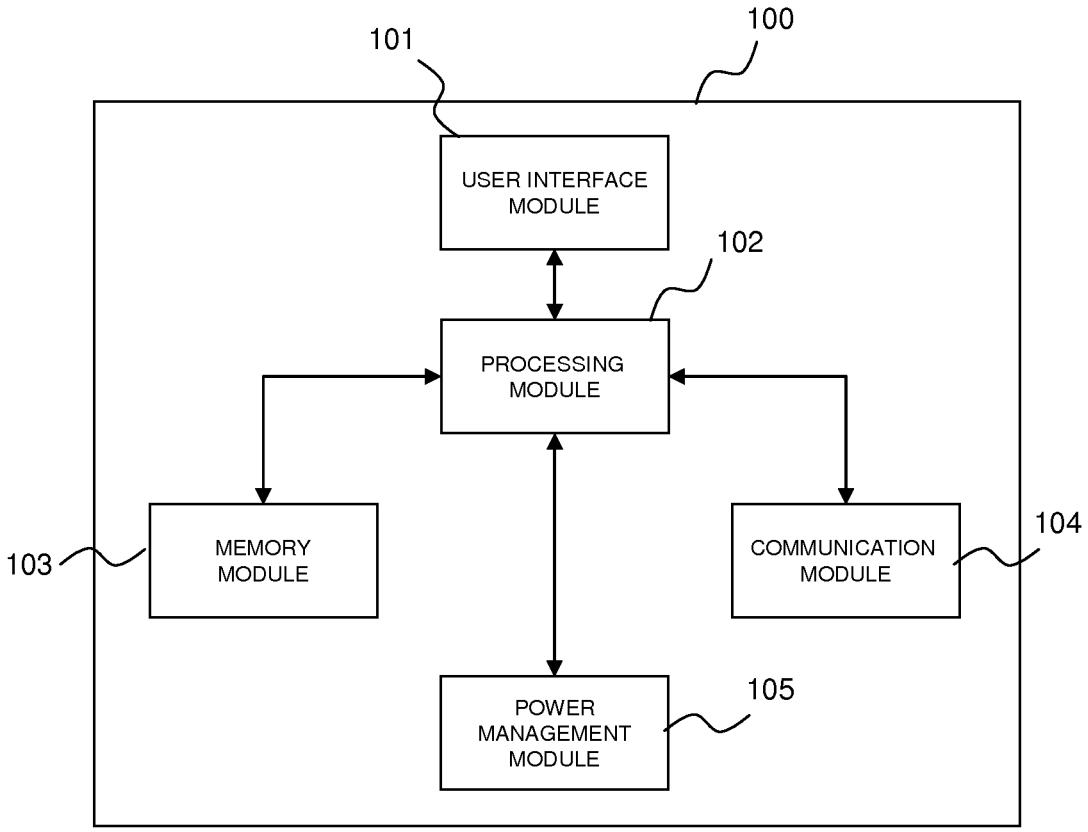

Referring now to FIG. 1*b*, it is shown a block diagram of the antennaless wireless handheld or portable device 100 capable of multiband operation advantageously comprising, in accordance to the present invention, a user interface module 101, a processing module 102, a memory module 103, a communication module 104 and a power management module 105. In a preferred embodiment, the processing module 102 and the memory module 103 have herein been listed as separate modules. However, in another embodiment, the processing module 102 and the memory module 103 may be separate functionalities within a single module or a plurality of modules. In a further embodiment, two or more of the five functional blocks of the antennaless wireless handheld or portable device 100 may be separate functionalities within a single module or a plurality of modules.

In FIG. 2, it is shown a schematic representation of three examples of radiating systems for an antennaless wireless handheld or portable device capable of multiband operation according to the present invention.

Figure 2A:
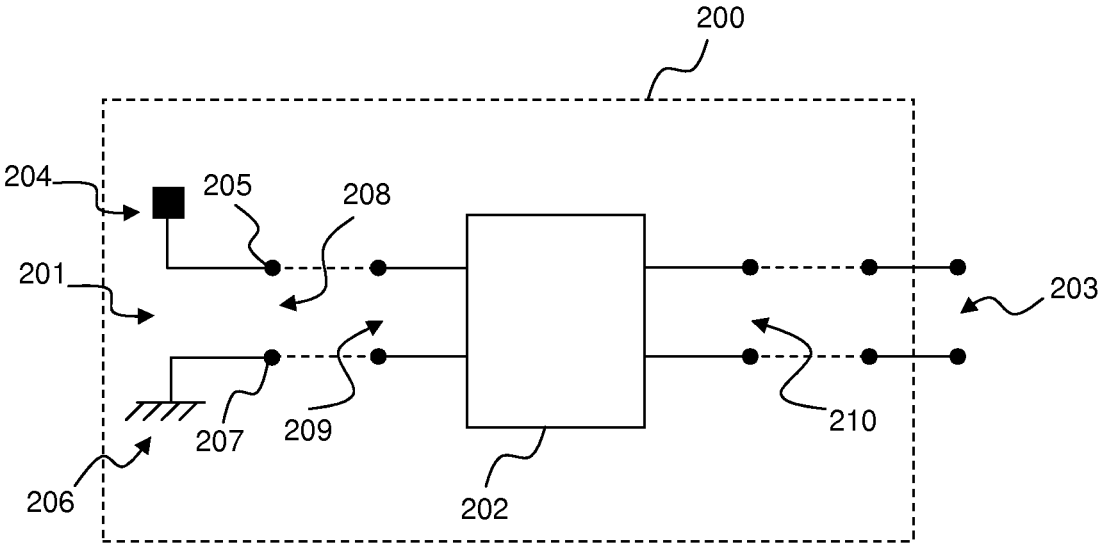
FIG. 2—Schematic representation of three examples of radiating systems according to the present invention.

In particular, in FIG. 2*a* a radiating system 200 comprises a radiating structure 201, a radiofrequency system 202, and an external port 203. The radiating structure 201 comprises a radiation booster 204, which includes a connection point 205, and a ground plane layer 206, said ground plane layer also including a connection point 207. The radiating structure 201 further comprises an internal port 208 defined between the connection point of the radiation booster 205 and the connection point of the ground plane layer 207. Furthermore, the radiofrequency system 202 comprises two ports: a first port 209 is connected to the internal port of the radiating structure 208, and a second port 210 is connected to the external port of the radiating system 203.

Figure 2B:
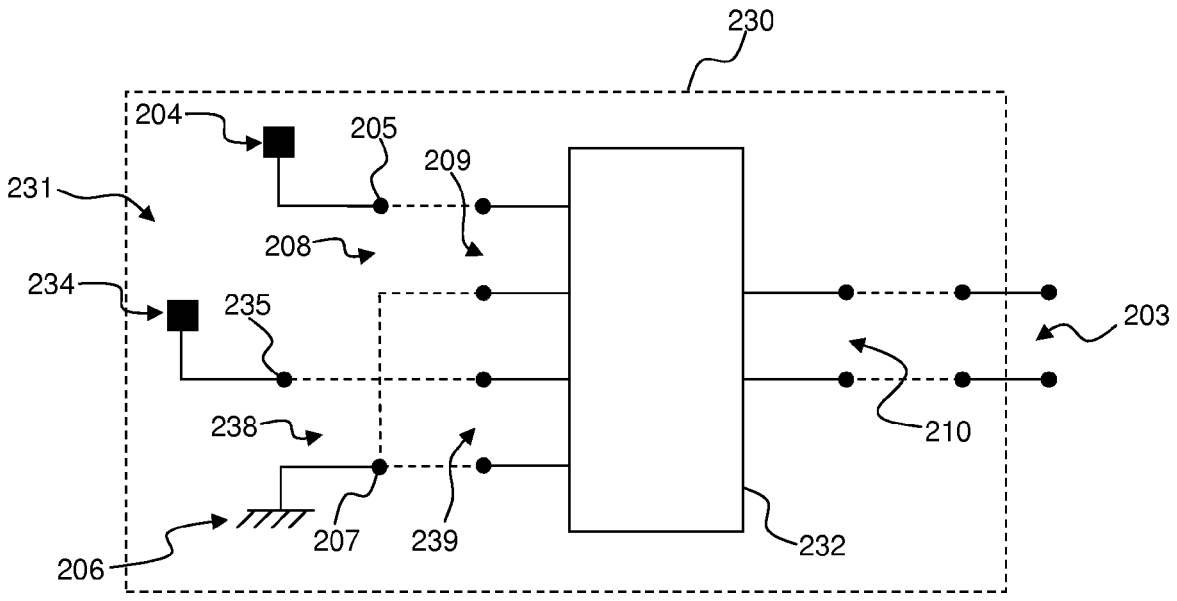

Referring now to FIG. 2*b*, a radiating system 230 comprises a radiating structure 231, which, in addition to a first radiation booster 204 and a ground plane layer 206, also includes a second radiation booster 234. The radiating structure 231 comprises two internal ports: A first internal port 208 is defined between a connection point of the first radiation booster 205 and a connection point of the ground plane layer 207; while a second internal port 238 is defined between a connection point of the second radiation booster 235 and the same connection point of the ground plane layer 207.

The radiating system 230 comprises a radiofrequency system 232 including three ports: A first port 209 is connected to the first internal port 208; a second port 239 is connected to the second internal port 238; and a third port 210 is connected to the external port of the radiating system 203. That is, the radiofrequency system 232 comprises a port connected to each of the at least one internal ports of the radiating structure 231, and a port connected to the external port of the radiating system 203.

Figure 2C:
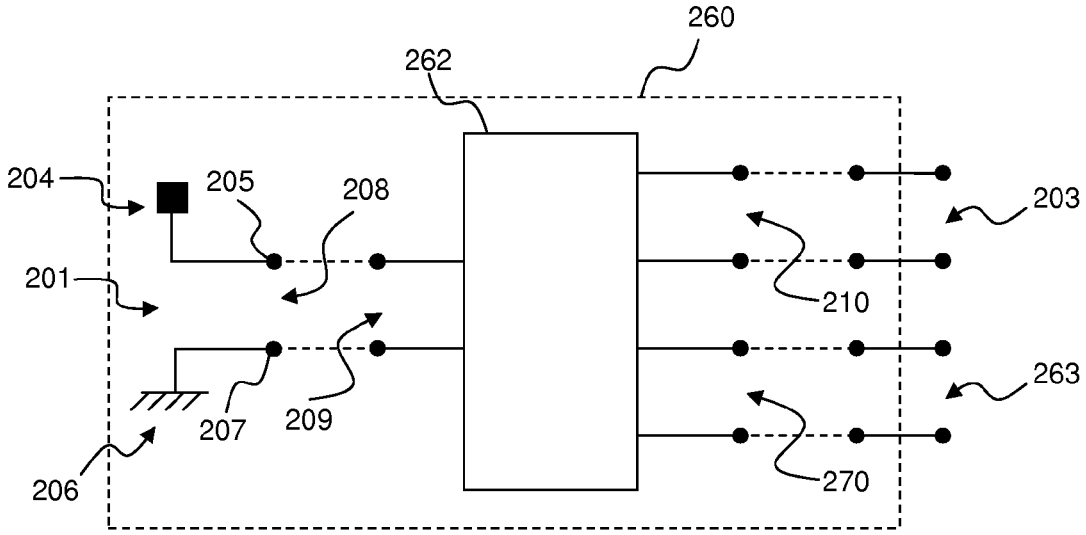

FIG. 2*c* depicts a further example of a radiating system 260 having the same radiating structure 201 as in the example of FIG. 2*a*. However, differently from the example of FIG. 2*a*, the radiating system 260 comprises an additional external port 263.

The radiating system 260 includes a radiofrequency system 262 having a first port 209 connected to the internal port of the radiating structure 208, a second port 210 connected to the external port 203, and a third port 270 connected to the additional external port 263.

Such a radiating system 260 may be preferred when said radiating system 260 is to provide operation in at least one cellular communication standard and at least one wireless connectivity standard. In one example, the external port 203 may provide the GSM 900 and GSM 1800 standards, while the external port 263 may provide an IEEE802.11 standard.

FIG. 3 shows the block diagram of three preferred examples of a matching network 300 for a radiofrequency system, the matching network 300 comprising a first port 301 and a second port 302. One of said two ports may at the same time be a port of a radiofrequency system and, in particular, be interconnected with an internal port of a radiating structure.

Figure 3A:
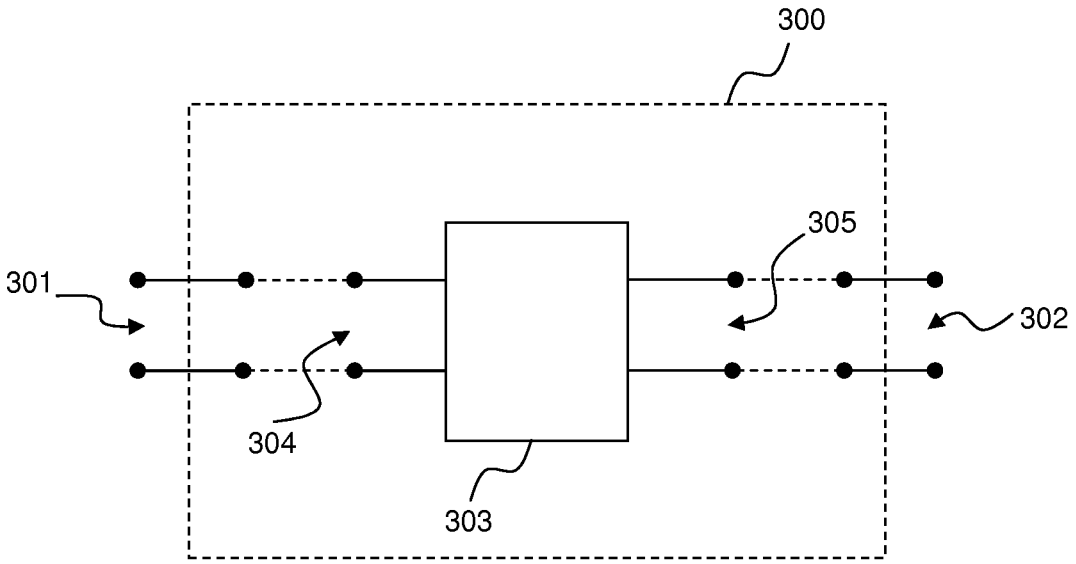
FIG. 3—Block diagram of three examples of matching networks for a radiofrequency system used in a radiating system according to the present invention.

In FIG. 3*a* the matching network 300 comprises a reactance cancellation circuit 303. In this example, a first port of the reactance cancellation circuit 304 may be operationally connected to the first port of the matching network 301 and another port of the reactance cancellation circuit 305 may be operationally connected to the second port of the matching network 302.

Figure 3B:
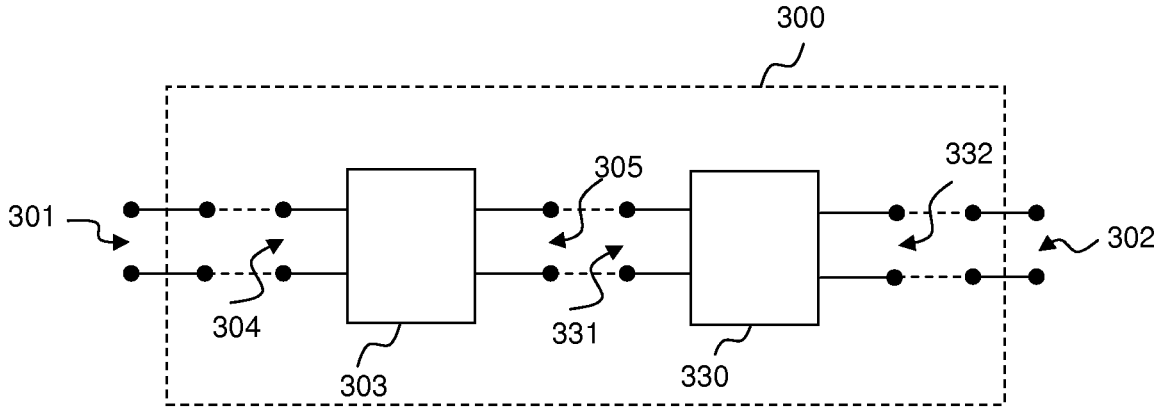

Referring now to FIG. 3*b*, the matching network 300 comprises the reactance cancellation circuit 303 and a broadband matching circuit 330, which is advantageously connected in cascade with the reactance cancellation circuit 303. That is, a port of the broadband matching circuit 331 is connected to port 305. In this example, port 304 is operationally connected to the first port of the matching network 301, while another port of the broadband matching circuit 332 is operationally connected to the second port of the matching network 302.

Figure 3C:
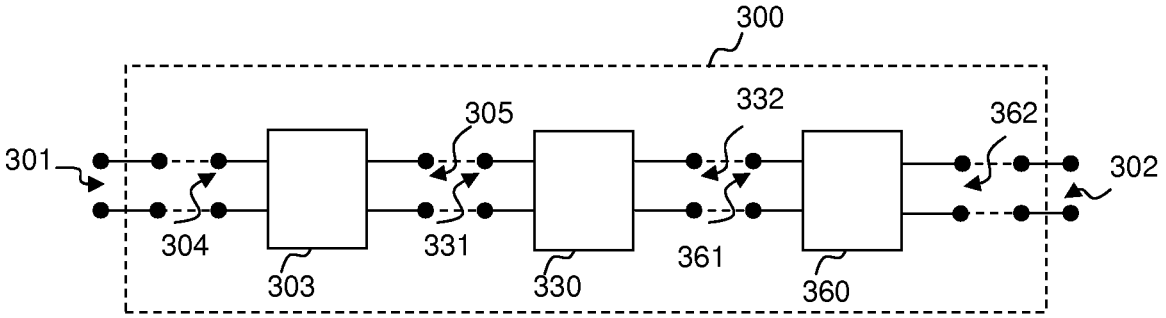

FIG. 3*c* depicts a further example of the matching network 300 comprising, in addition to the reactance cancellation circuit 303 and the broadband matching circuit 330, a fine tuning circuit 360. Said three circuits are advantageously connected in cascade, with a port of the reactance cancellation circuit (in particular port 304) being connected to the first port of the matching network 301 and a port the fine tuning circuit 362 being connected to the second port of the matching network 302. In this example, the broadband matching circuit 330 is operationally interconnected between the reactance cancellation circuit 303 and the fine tuning circuit 360 (i.e., port 331 is connected to port 305 and port 332 is connected to port 361 of the fine tuning circuit 360).

The radiofrequency systems 202, 232, 262 in the example radiating systems of FIG. 2 may advantageously include at least one, and preferably two, matching networks such as the matching network 300 of FIGS. 3*a-c*.

Figure 4A:
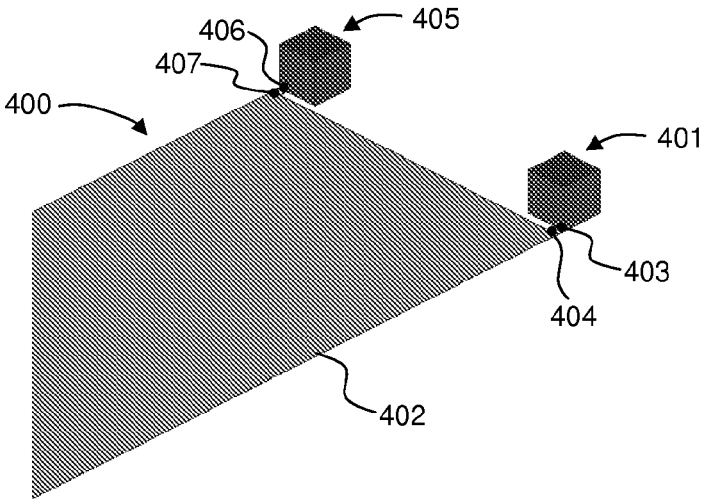
FIG. 4—Example of a radiating structure for a radiating system, the radiating structure including a first and a second radiation booster, each comprising a conductive part: (a) Partial perspective view; and (b) top plan view.

FIG. 4 shows a preferred example of a radiating structure suitable for a radiating system operating in a first frequency region of the electromagnetic spectrum between 824 MHz and 960 MHz and in a second frequency region of the electromagnetic spectrum between 1710 MHz and 2170 MHz. An antennaless wireless handheld or portable device including such a radiating system may advantageously operate the GSM 850, GSM 900, GSM1800, GSM1900 and UMTS cellular communication standards (i.e., five different communication standards).

Figure 4B:
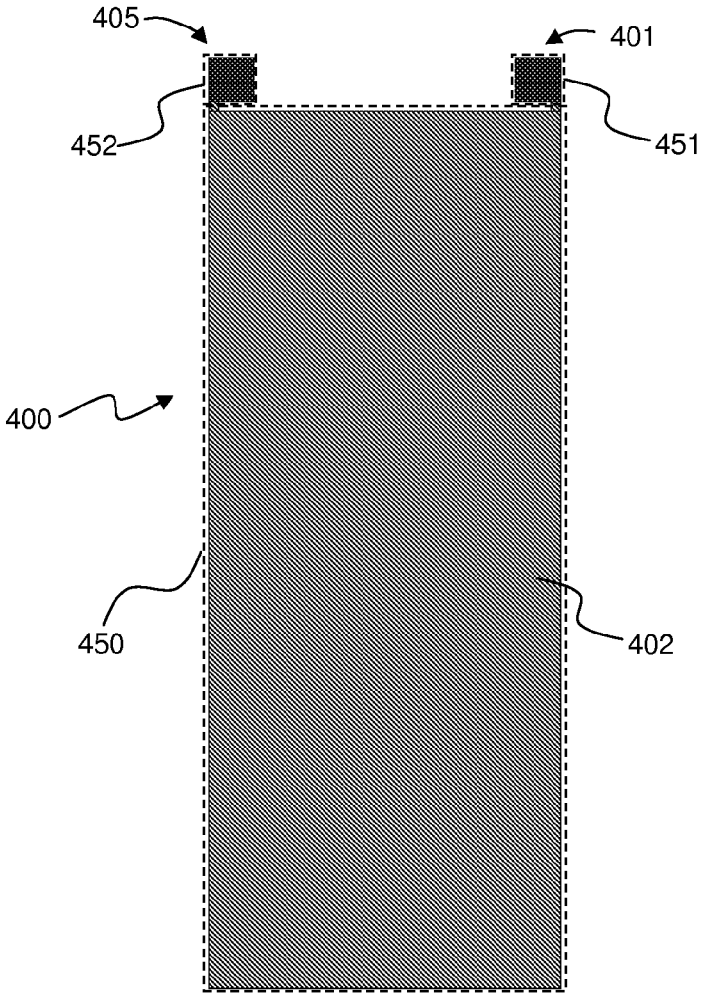

The radiating structure 400 comprises a first radiation booster 401, a second radiation booster 405, and a ground plane layer 402. In FIG. 4*b*, there is shown in a top plan view the ground plane rectangle 450 associated to the ground plane layer 402. In this example, since the ground plane layer 402 has a substantially rectangular shape, its ground plane rectangle 450 is readily obtained as the rectangular perimeter of said ground plane layer 402.

The ground plane rectangle 450 has a long side of approximately 100 mm and a short side of approximately 40 mm. Therefore, in accordance with an aspect of the present invention, the ratio between the long side of the ground plane rectangle 450 and the free-space wavelength corresponding to the lowest frequency of the first frequency region (i.e., 824 MHz) is advantageously larger than 0.2. Moreover, said ratio is advantageously also smaller than 1.0.

In this example, the first radiation booster 401 and the second radiation booster 405 are of the same type, shape and size. However, in other examples the radiation boosters 401, 405 could be of different types, shapes and/or sizes. Thus, in FIG. 4 each of the first and the second radiation boosters 401, 405 includes a conductive part featuring a polyhedral shape comprising six faces. Moreover, in this case said six faces are substantially square having an edge length of approximately 5 mm, which means that said conductive part is a cube. In this case, the conductive part of each of the two radiation boosters 401, 405 is not connected to the ground plane layer 402. A first booster box 451 for the first radiation booster 401 coincides with the external area of said first radiation booster 401. Similarly, a second booster box 452 for the second radiation booster 405 coincides with the external area of said second radiation booster 405. In FIG. 4*b*, it is shown a top plan view of the radiating structure 400, in which the top face of the first booster box 451 and that of the second booster box 452 can be observed.

In accordance with an aspect of the present invention, a maximum size of the first radiation booster 401 (said maximum size being a largest edge of the first booster box 451) is advantageously smaller than 1/50 times the free-space wavelength corresponding to the lowest frequency of the first frequency region of operation of the radiating structure 400, and a maximum size of the second radiation booster 405 (said maximum size being a largest edge of the second booster box 452) is also advantageously smaller than 1/50 times said free-space wavelength. In particular, said maximum sizes of the first and second radiation boosters 401, 405 are also advantageously larger than 1/180 times said free-space wavelength.

Furthermore in this example, the first and second radiation boosters have each a maximum size smaller than 1/30 times the free-space wavelength corresponding to the lowest frequency of the second frequency region of operation of the radiating structure 400, but advantageously larger than 1/120 times said free-space wavelength.

In FIG. 4, the first and second radiation boosters 401, 405 are arranged with respect to the ground plane layer 402 so that the upper and bottom faces of the first radiation booster 401 and the upper and bottom faces of the second radiation booster 405 are substantially parallel to the ground plane layer 402. Moreover, the bottom face of the first radiation booster 401 is advantageously coplanar to the bottom face of the second radiation booster 405, and the bottom faces of both radiation boosters 401, 405 are also advantageously coplanar to the ground plane layer 402. With such an arrangement, the height of the radiation boosters 401, 405 with respect to the ground plane layer is not larger than 2% of the free-space wavelength corresponding to the lowest frequency of the first frequency region.

In the radiating structure 400, the first radiation booster 401 and the second radiation booster 405 protrude beyond the ground plane layer 402. That is, the radiation boosters 401, 405 are arranged with respect to the ground plane layer 402 in such a manner that there is no ground plane in the orthogonal projection of the radiation boosters 401, 405 onto the plane containing the ground plane layer 402. The first radiation booster 401 is located substantially close to a first corner of the ground plane layer 402, while the second radiation booster 405 is located substantially close to a second corner of said ground plane layer 402. In particular, said first and second corners are at opposite ends of a short edge of the substantially rectangular ground plane layer 402.

The first radiation booster 401 comprises a connection point 403 located on the lower right corner of the bottom face of the first radiation booster 401. In turn, the ground plane layer 402 also comprises a first connection point 404 substantially on the upper right corner of the ground plane layer 402. A first internal port of the radiating structure 400 is defined between said connection point 403 and said first connection point 404.

Similarly, the second radiation booster 405 comprises a connection point 406 located on the lower left corner of the bottom face of the second radiation booster 405, and the ground plane layer 402 also comprises a second connection point 407 substantially on the upper left corner of the ground plane layer 402. A second internal port of the radiating structure 400 is defined between said connection point 406 and said second connection point 407.

In an alternative example, the ground plane layer 402 of the radiating structure 400 may comprise only the first connection point 404 (i.e., only one connection point). In that case the second internal port could have been defined between the connection point 406 of the second radiation booster 405 and said first connection point 404.

The very small dimensions of the first and second radiation boosters 401, 405 result in said radiating structure 400 having at each of the first and second internal ports a first resonance frequency at a frequency much higher than the frequencies of the first frequency region. In this case, the ratio between the first resonance frequency of the radiating structure 400 measured at each of the first and second internal ports (in absence of a radiofrequency system connected to them) and the highest frequency of the first frequency region is advantageously larger than 4.2.

Furthermore, the first resonance frequency at each of the first and second internal ports of the radiating structure 400 is also at a frequency much higher than the frequencies of the second frequency region.

Figure 7A:
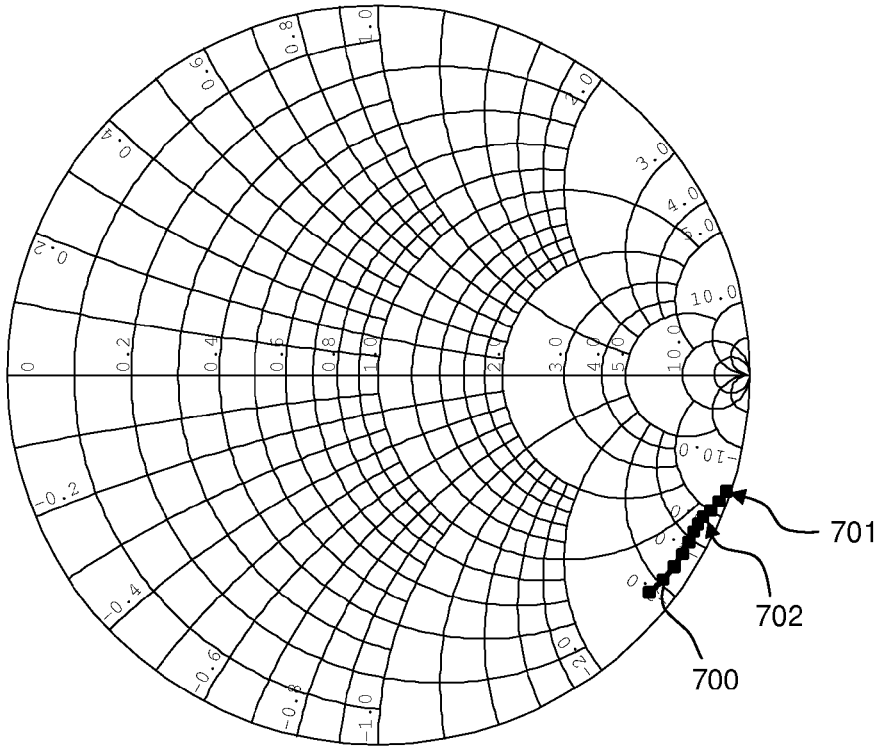
FIG. 7—Typical impedance transformation caused by the matching network of FIG. 6 on the input impedance at the first internal port of the radiating structure of FIG. 4: (a) Input impedance at the first internal port when disconnected from the matching network of the radiofrequency system; (b) Input impedance after connection of a reactance cancellation circuit to the first internal port; and (c) Input impedance after connection of a broadband matching circuit in cascade with the reactance cancellation circuit.
Figure 8A:
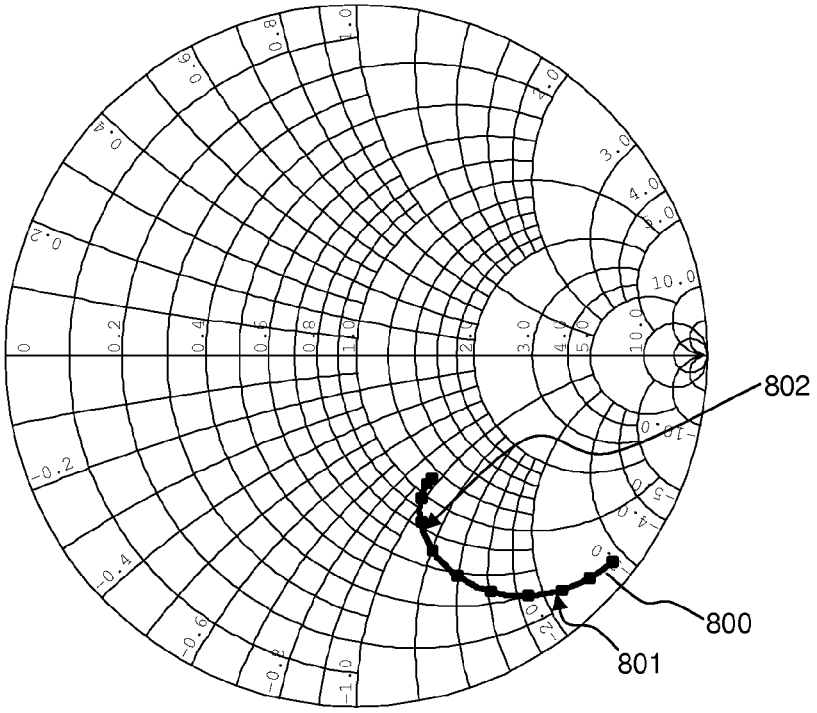
FIG. 8—Typical impedance transformation caused by a matching network similar to that of FIG. 6 on the input impedance at the second internal port of the radiating structure of FIG. 4: (a) Input impedance at the second internal port when disconnected from the matching network of the radiofrequency system; (b) Input impedance after connection of a reactance cancellation circuit to the second internal port; and (c) Input impedance after connection of a broadband matching circuit in cascade with said reactance cancellation circuit.

With such small dimensions of the first and second radiation boosters 401, 405, the input impedance of the radiating structure 400 measured at each of the first and second internal ports features an important reactive component, and in particular a capacitive component, within the frequencies of the first and second frequency regions, as it can be observed in FIGS. 7*a* and 8*a*.

In FIG. 7*a*, curve 700 represents on a Smith chart the typical complex impedance at the first internal port of the radiating structure 400 as a function of the frequency when no radiofrequency system is connected to said first internal port. In particular, point 701 corresponds to the input impedance at the lowest frequency of the first frequency region, and point 702 corresponds to the input impedance at the highest frequency of the first frequency region.

Curve 700 is located on the lower half of the Smith chart, which indeed indicates that the input impedance at the first internal port has a capacitive component (i.e., the imaginary part of the input impedance has a negative value) for at least all frequencies of the first frequency range (i.e., between point 701 and point 702). Although not represented in FIG. 7*a*, the input impedance at the first internal port has also a capacitive component for all frequencies of the second frequency region (i.e., curve 700 remains in the lower half of the Smith chart for all frequencies of the second frequency region).

As far as the second internal port of the radiating structure 400 is concerned, curve 800 in FIG. 8*a* represents the typical complex impedance at said second internal port as a function of the frequency in absence of any radiofrequency system connected to it. Point 801 corresponds to the input impedance at the lowest frequency of the second frequency region, and point 802 corresponds to the input impedance at the highest frequency of the second frequency region.

Curve 800 is also located on the lower half of the Smith chart, indicating that the input impedance at the second internal port has a capacitive component for at least all frequencies of the second frequency range (i.e., between point 801 and point 802). Moreover, despite not being shown in FIG. 8*a*, the input impedance at the second internal port has also a capacitive component for all frequencies of the first frequency region (i.e., curve 800 remains in the lower half of the Smith chart for all frequencies of the first frequency region).

Figure 5:
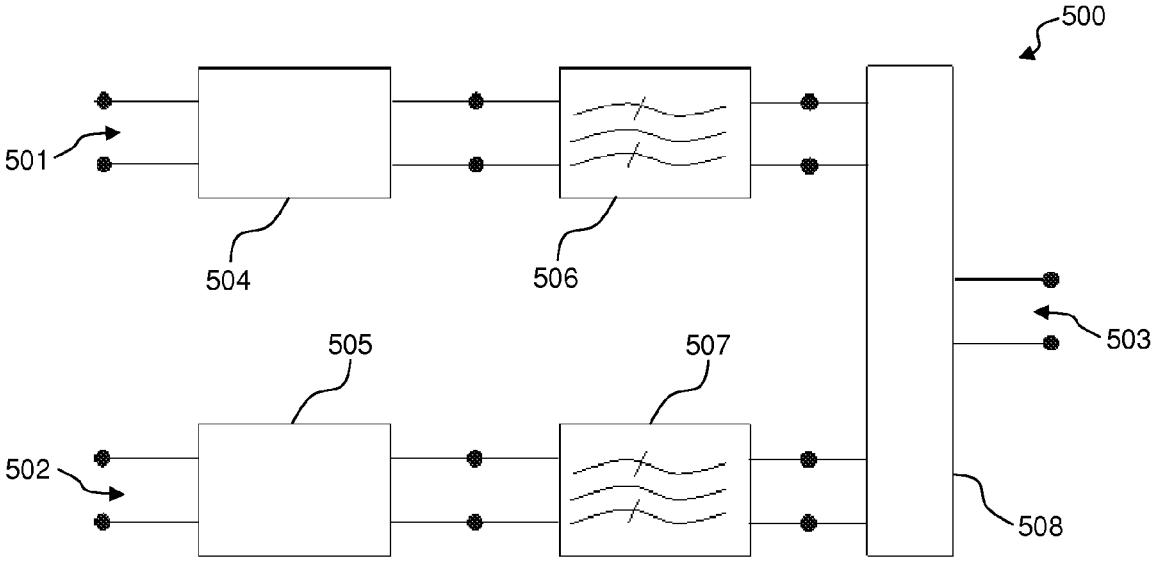
FIG. 5—Schematic representation of a radiofrequency system for a radiating system whose radiating structure is shown in FIG. 4.

FIG. 5 presents a schematic of a radiofrequency system 500 to be connected to the two internal ports of the radiating structure 400 in order to transform the input impedance of the radiating structure 400 and provide impedance matching in the first and second regions of operation of the radiating system.

The radiofrequency system 500 comprises two ports 501, 502 to be connected respectively to the first and second internal ports of the radiating structure 400, and a third port 503 to be connected to a single external port of the radiating system.

The radiofrequency system 500 also comprises a first matching network 504 connected to port 501, providing impedance matching within the first frequency region; and a second matching network 505 connected to port 502, providing impedance matching within the second frequency region.

The radiofrequency system 500 further comprises a first band-pass filter 506 connected to said first matching network 504, and a second band-pass filter 507 connected to said second matching network 505. The first band-pass filter 506 is designed to present low insertion loss in the first frequency region and high impedance in the second frequency region of operation of the radiating system. Analogously, the second band-pass filter 507 is designed to present low insertion loss in said second frequency region and high impedance in said first frequency region.

The radiofrequency system 500 additionally includes a combiner/splitter 508 to combine (or split) the electrical signals of different frequency regions. Said combiner/splitter 508 is connected to the first and second band-pass filters 506, 507, and to the port 503.

Figure 6A:
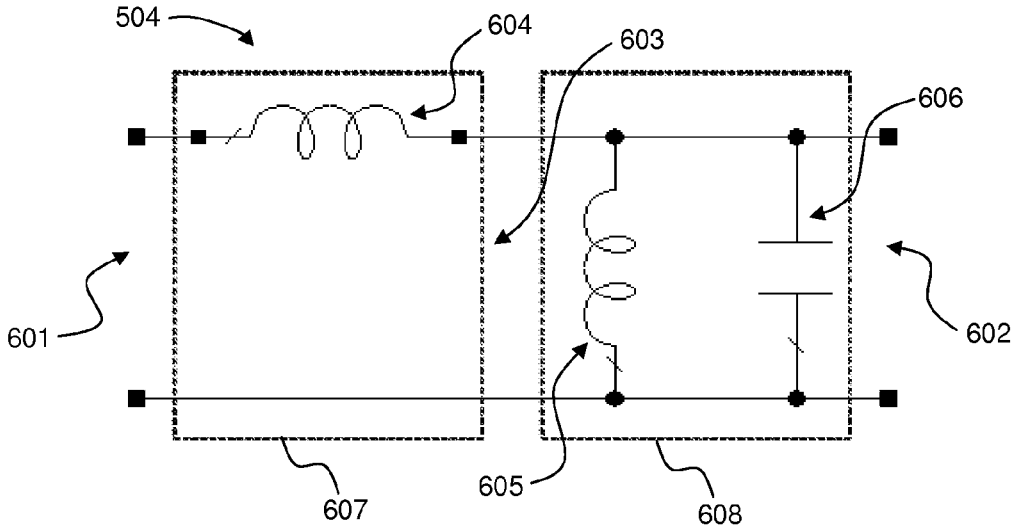
FIG. 6—(a) Schematic representation of a matching network used in the radiofrequency system of FIG. 5; and (b) Schematic representation of a first and a second band-pass filter and a combiner/splitter used in the radiofrequency system of FIG. 5.
Figure 6B:
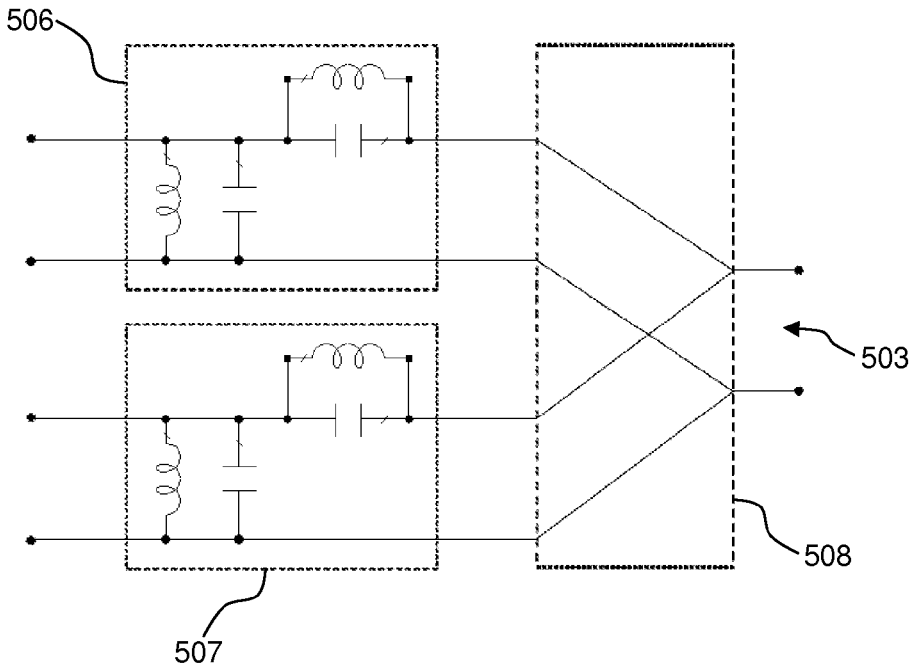

FIG. 6*b* shows a schematic representation of the first and second band-pass filters 506, 507 and the combiner/splitter 508.

The first and second band-pass filters 506, 507 comprise each at least two stages, and preferably at least one of said at least two stages includes an LC-resonant circuit. In the particular example shown in FIG. 6*b*, the first and the second band-pass filter 506, 507 have each two stages in an L-shaped (i.e., parallel—series) arrangement. Furthermore, each of said two stages includes an LC-resonant circuit formed by a lumped capacitor in parallel with a lumped inductor.

In some examples, the combiner/splitter 508 can be advantageously constructed by directly connecting in parallel the two band-pass filters 506, 507 to the port 503, as it is shown in the example of FIG. 6*b*. This is possible because in the first frequency region the second band-pass filter 507 does not load the port 503, while in the second frequency region the first band-pass filter 506 does not load the port 503. In other words, it is as if only one of the two matching networks were effectively connected to the port 503 in each frequency region.

FIG. 6*a* is a schematic representation of the matching network 504, which comprises a first port 601 to be connected to the first internal port of the radiating structure 400 (via the port 501 of the radiofrequency system 500), and a second port 602 to be connected to the first band-pass filter 506 of the radiofrequency system 500. In this example, the matching network 504 further comprises a reactance cancellation circuit 607 and a broadband matching circuit 608.

The reactance cancellation circuit 607 includes one stage comprising one single circuit component 604 arranged in series and featuring a substantially inductive behavior in the first and second frequency regions. In this particular example, the circuit component 604 is a lumped inductor. The inductive behavior of the reactance cancellation circuit 607 advantageously compensates the capacitive component of the input impedance of the first internal port of the radiating structure 400.

Figure 7B:
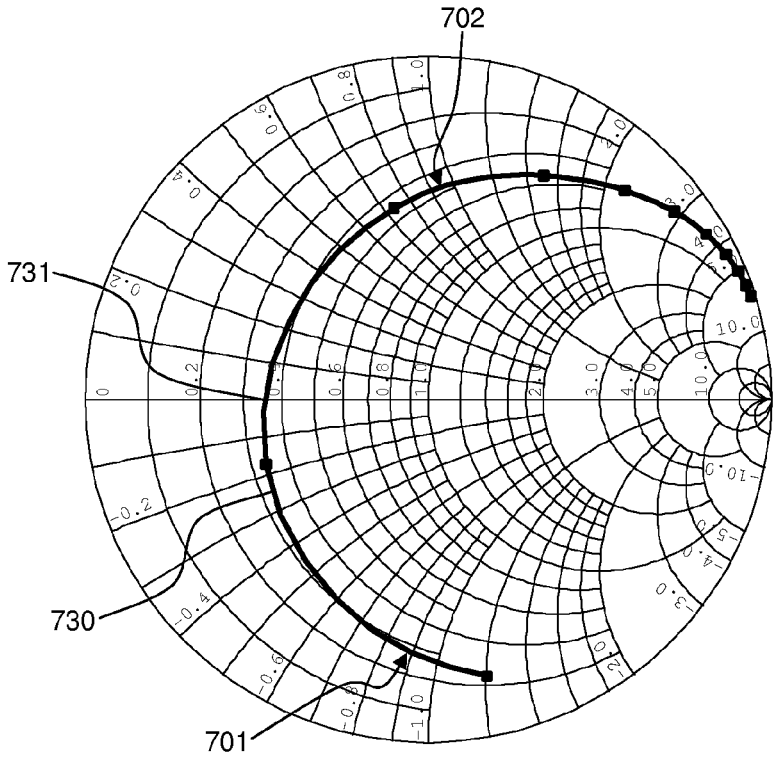

Such a reactance cancellation effect can be observed in FIG. 7*b*, in which the input impedance at the first internal port of the radiating structure 400 (curve 700 in FIG. 7*a*) is transformed by the reactance cancellation circuit 607 into an impedance having an imaginary part substantially close to zero in the first frequency region (see FIG. 7*b*). Curve 730 in FIG. 7*b* corresponds to the input impedance that would be observed at the second port 602 of the first matching network 504 (when disconnected from the first band-pass filter 506) if the broadband matching circuit 608 were removed and said second port 602 were directly connected to a port 603. Said curve 730 crosses the horizontal axis of the Smith Chart at a point 731 located between point 701 and point 702, which means that the input impedance at the first internal port of the radiating structure 400 has an imaginary part equal to zero for a frequency advantageously between the lowest and highest frequencies of the first frequency region.

The broadband matching circuit 608 includes also one stage and is connected in cascade with the reactance cancellation circuit 607. Said stage of the broadband matching circuit 608 comprises two circuit components: a first circuit component 605 is a lumped inductor and a second circuit component 606 is a lumped capacitor. Together, the circuit components 605 and 606 form a parallel LC resonant circuit (i.e., said stage of the broadband matching circuit 608 behaves substantially as a resonant circuit in the first frequency region of operation).

Figure 7C:
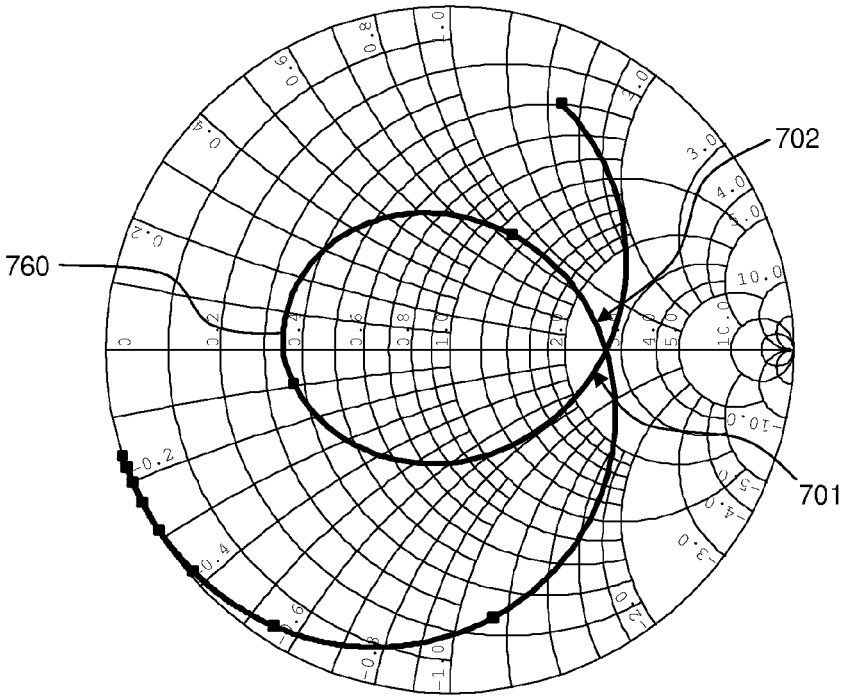

Comparing FIGS. 7*b* and 7*c*, it is noticed that the broadband matching circuit 608 has the beneficial effect of "closing in" the ends of curve 730 (i.e., transforming the curve 730 into another curve 760 featuring a compact loop around the center of the Smith chart). Thus, the resulting curve 760 exhibits an input impedance (now, measured at the second port 602 when disconnected from the first band-pass filter 506) within a voltage standing wave ratio (VSWR) 3:1 referred to a reference impedance of 50 Ohms over a broader range of frequencies.

In this particular example, the second matching network 505 of the radiofrequency system 500 has the same configuration as that of the first matching network 504 shown in FIG. 6*a*: A reactance cancellation circuit that includes one stage comprising one single circuit component arranged in series and featuring a substantially inductive behavior in the first and second frequency regions; and a broadband matching circuit connected in cascade with the reactance cancellation circuit and that includes also one stage, said stage comprising two circuit components that form a parallel LC resonant circuit so that said stage behaves substantially as a resonant circuit in the second frequency region of operation. Said second matching network also comprises a first port to be connected to the second internal port of the radiating structure 400 (via the port 502 of the radiofrequency system 500), and a second port to be connected to the second band-pass filter 507.

Despite the fact that the first and second matching networks 504, 505 have the same configuration, the different frequency ranges in which each matching network is to provide impedance matching makes the actual values of the circuit components used in each matching network be possibly different.

Figure 8B:
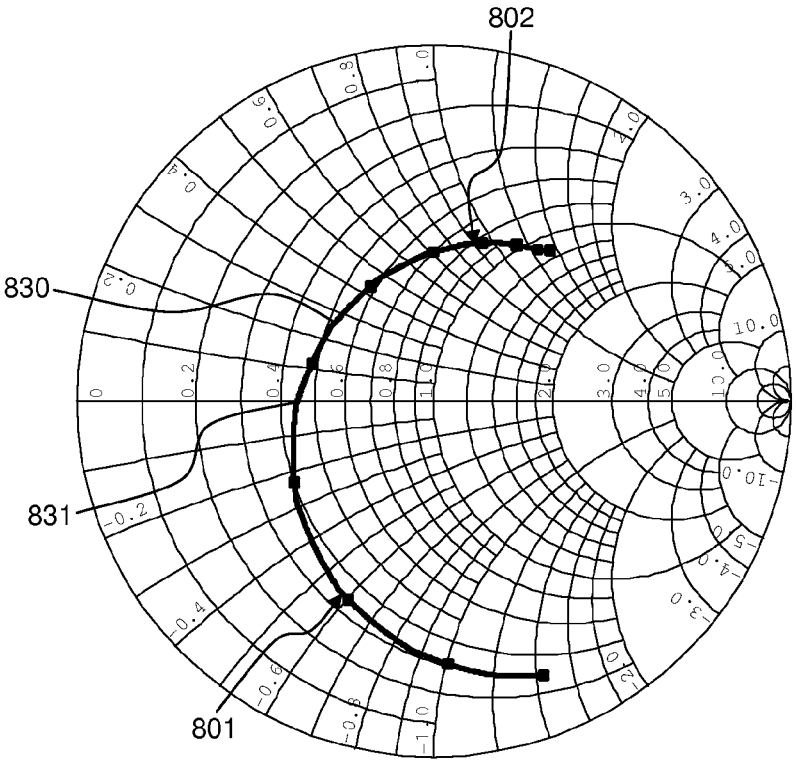

The effect of the reactance cancellation circuit of the second matching network 505 on the input impedance at the second internal port of the radiating structure 400 is shown in FIG. 8*b*, in which the input impedance at said second internal port (curve 800 in FIG. 8*a*) is transformed into an impedance having an imaginary part substantially close to zero in the second frequency region. Curve 830 in FIG. 8*b* corresponds to the input impedance that would be observed at the second port of the second matching network 505 (when disconnected from the first band-pass filter 507) if said second matching network 505 had only a reactance cancellation circuit operationally connected between its first and second ports. Said curve 830 crosses the horizontal axis of the Smith Chart at a point 831 located between point 801 and point 802, which means that the input impedance at the second internal port of the radiating structure 400 has an imaginary part equal to zero for a frequency advantageously between the lowest and highest frequencies of the second frequency region.

Figure 8C:
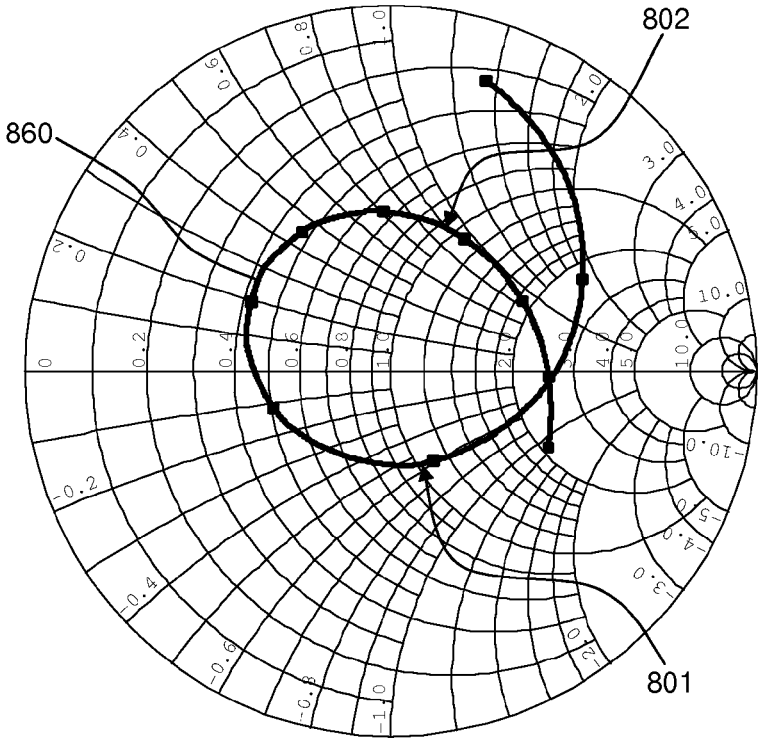

Finally, the broadband matching circuit of the second matching network 505 transforms the curve 830 in FIG. 8*b* into another curve 860 (in FIG. 8*c*) that features a compact loop around the center of the Smith chart. Thus, the resulting curve 860 exhibits an input impedance (now, measured at the second port of the second matching network 505 when disconnected from the second band-pass filter 507) within a VSWR 3:1 referred to a reference impedance of 50 Ohms over a broader range of frequencies.

Figure 9A:
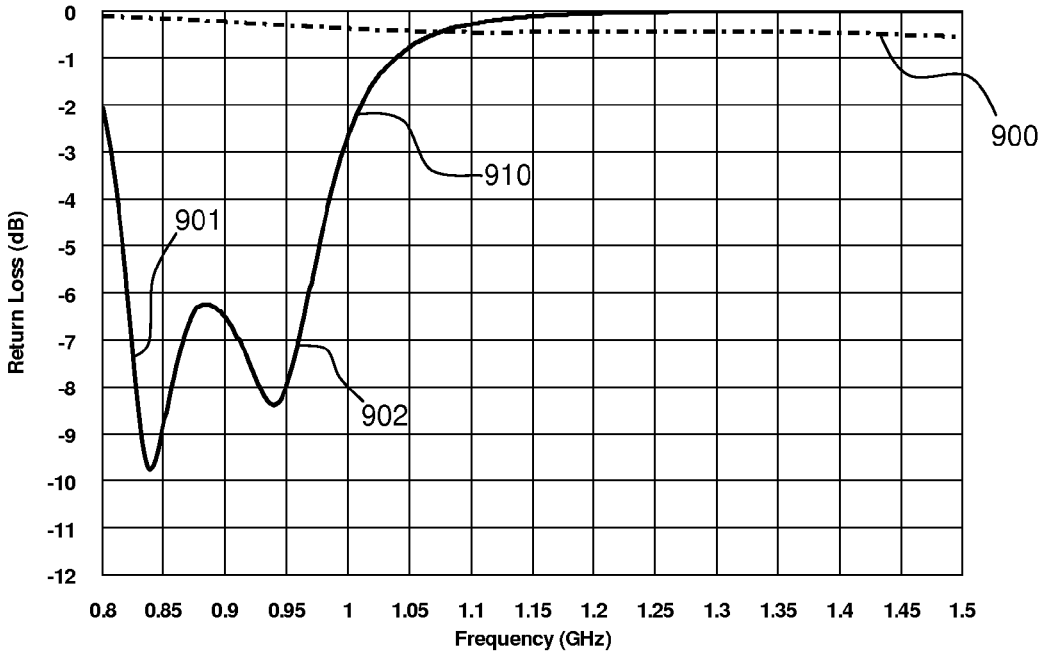
FIG. 9—(a) Typical input return losses at the first internal port of the radiating structure of FIG. 4 compared with those after interconnection of the matching network of FIG. 6 to the first internal port of the radiating structure; and (b) Typical input return losses at the second internal port of the radiating structure of FIG. 4 compared with those after interconnection of a matching network similar to that of FIG. 6 to the second internal port of the radiating structure.

Alternatively, the effect of the first and second matching networks of the radiofrequency system of FIG. 5 on the radiating structure of FIG. 4 can be compared in terms of the input return loss. In FIG. 9*a* curve 900 (in dash-dotted line) presents the typical input return loss of the radiating structure 400 observed at its first internal port when the radiofrequency system 500 is not connected to said first internal port. From said curve 900 it is clear that the radiating structure 400 is not matched in the first frequency region and that the first radiation booster 401 is non-resonant in said first frequency region. On the other hand, curve 910 (in solid line) corresponds to the input return losses at the second port 602 of the first matching network 504 (when disconnected from the first band-pass filter 506).

Figure 9B:
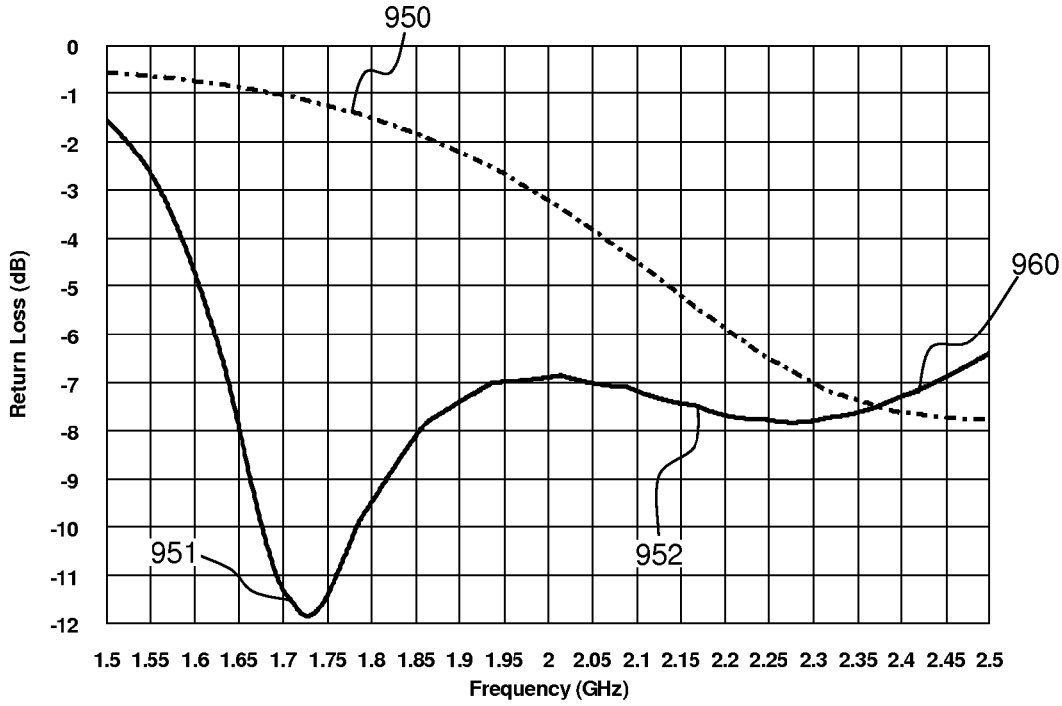

Likewise, in FIG. 9*b* curve 950 (in dash-dotted line) presents the typical input return loss of the radiating structure 400 observed at its second internal port when the radiofrequency system 500 is not connected to said second internal port. From said curve 950 it is clear that the radiating structure 400 is not matched in the second frequency region and that the second radiation booster 405 is non-resonant in said second frequency region. On the other hand, curve 960 (in solid line) corresponds to the input return losses at the second port of the second matching network 505 (when disconnected from the second band-pass filter 507).

The first and second matching networks 504, 505 of the radiofrequency system 500 transform the input impedance of the first and second internal ports of the radiating structure 400 to provide impedance matching respectively in the first and second frequency regions. Indeed, curve 910 exhibits return losses better than −6 dB in the first frequency region (delimited by points 901 and 902 on the curve 910), while curve 960 exhibits return losses better than −6 dB in the second frequency region (delimited by points 951 and 952 on the curve 960).

Figure 10:
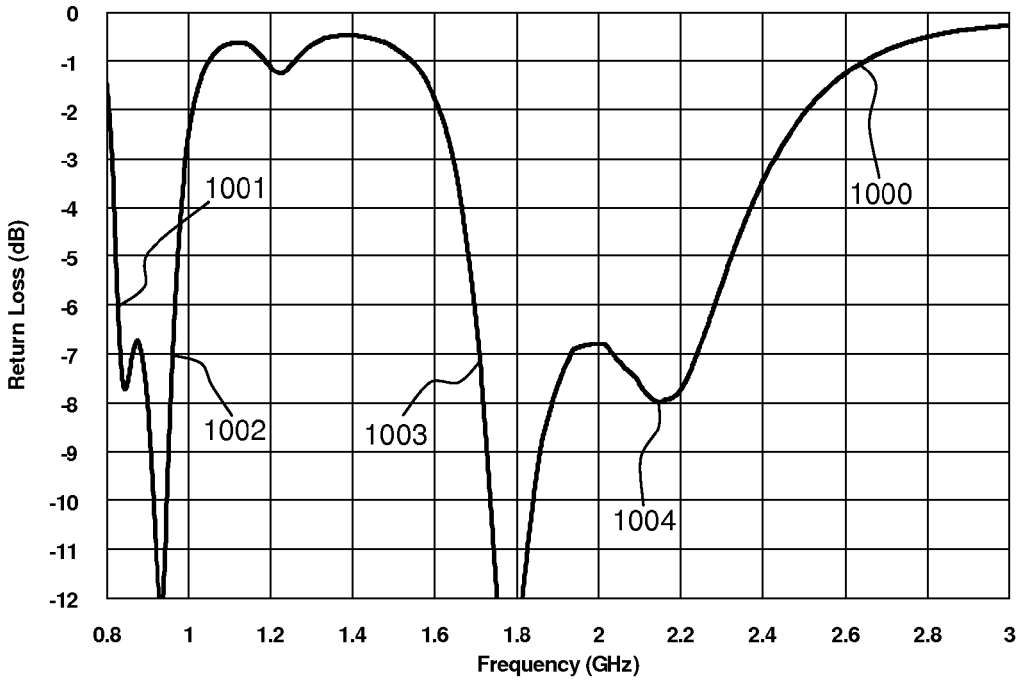
FIG. 10—Typical input return losses at the external port of the radiating system resulting from the interconnection of the radiating system of FIG. 5 to the radiating structure of FIG. 4.

Finally, the frequency response of the radiating system resulting from the interconnection of the radiating system of FIG. 5 to the radiating structure of FIG. 4 is shown in FIG. 10, in which the curve 1000 corresponds to the return loss observed at the external port of the radiating system. The return loss curve 1000 exhibits a better than −6 dB behavior in the first frequency region (delimited by points 1001 and 1002 on said curve 1000) and in the second frequency region (delimited by points 1003 and 1004), making it possible for the radiating system to provide operability for the GSM850, GSM900, GSM1800, GSM1900 and UMTS standards.

Figure 11:
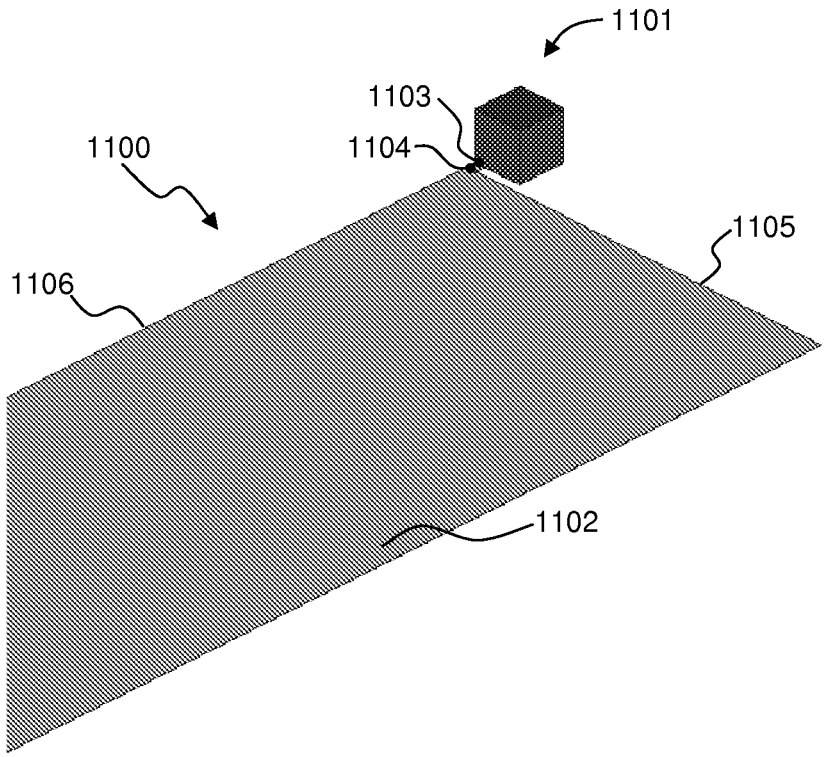
FIG. 11—Example of a radiating structure for a radiating system according to the present invention, the radiating structure including only one radiation booster.

FIG. 11 shows another radiating structure 1100 for a radiating system capable of operating in a first and in a second frequency region of the electromagnetic spectrum when an appropriate radiofrequency system is connected to said radiating structure 1100.

As in the previous examples, the radiating structure 1100 comprises a substantially rectangular ground plane layer 1102 and a first radiation booster 1101. However, there is no second radiation booster. That is, the radiating structure 1100 has only one radiation booster.

The first radiation booster 1101 protrudes beyond the ground plane layer 1102 (i.e., there is no ground plane in the orthogonal projection of the radiation booster 1101 onto the plane containing the ground plane layer 1102). Moreover, said first radiation booster 1101 is advantageously located substantially close to a corner of the ground plane layer 1102, said corner being defined by the intersection of a short edge 1105 and a long edge 1106 of the ground plane layer 1102.

The first radiation booster 1101 comprises a connection point 1103, which defines together with a connection point of the ground plane layer 1104 an internal port of the radiating structure 1100.

In this example, the first radiation booster 1101 (i.e., a same radiation booster) in cooperation with a radiofrequency system advantageously excites at least two different radiation modes on the ground plane layer 1102 responsible for the operation of the resulting radiating system in said first and second frequency regions of the electromagnetic spectrum.

Figure 12:
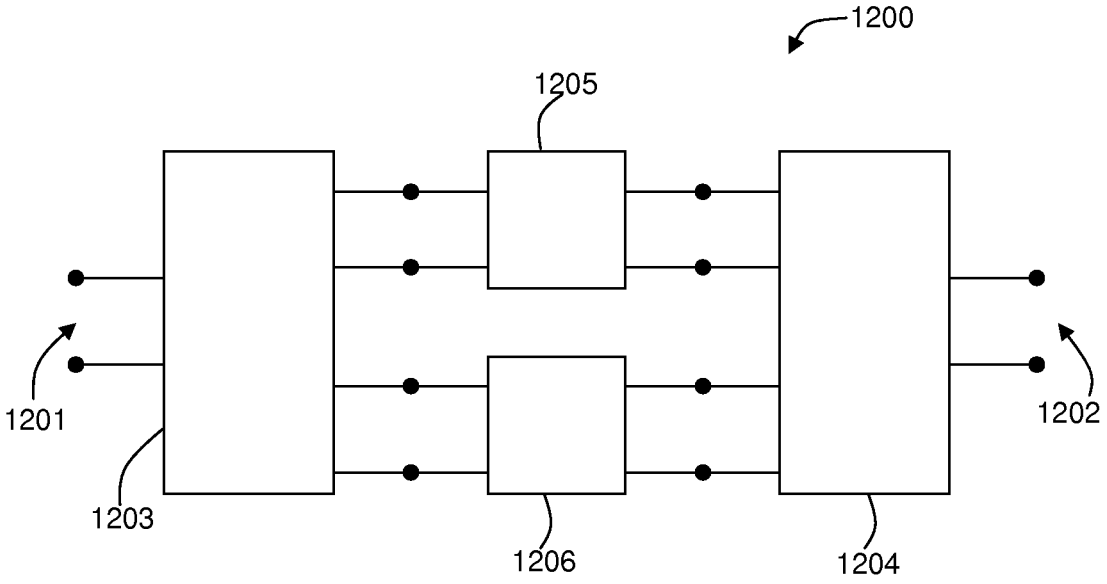
FIG. 12—Schematic representation of a radiofrequency system for a radiating system whose radiating structure is shown in FIG. 11.
Figure 13:
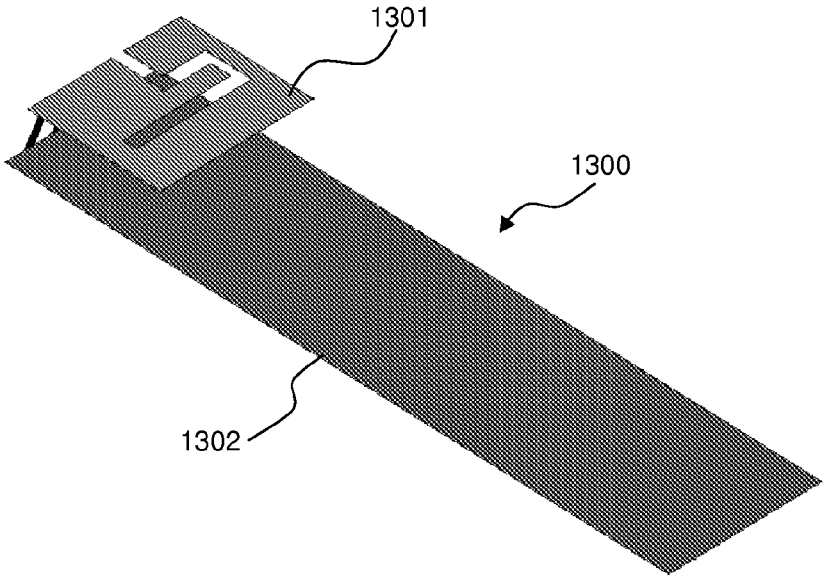
(PRIOR ART) FIG. 13
FIG. 13—Radiating structure of a typical wireless handheld or portable device.

FIG. 12 shows an example of a radiofrequency system suitable for interconnection with the radiating structure of FIG. 11. The radiofrequency system 1200 comprises a first diplexer 1203 to separate the electrical signals of a first and a second frequency regions of operation of a radiating system, a first matching network 1205 to provide impedance matching in said first frequency region, a second matching network 1206 to provide impedance matching in said second frequency region, and a second diplexer 1204 to recombine the electrical signals of said first and second frequency regions.

Each of the first and second matching networks 1205, 1206 may be as in any of the examples of matching networks described in connection with FIG. 3.

The first diplexer 1203 is connected to a first port 1201, while the second diplexer 1204 is connected to a second port 1202. In a radiating system, an internal port of a radiating structure (such as for instance the internal port of the radiating structure 1100) may be connected to said first port 1201, while an external port of the radiating system may be connected to said second port 1202.

The use of diplexers in the radiofrequency system is advantageous to separate the electrical signals of different frequency regions and transform the input impedance characteristics in each frequency region independently from the others.

Figure 14:
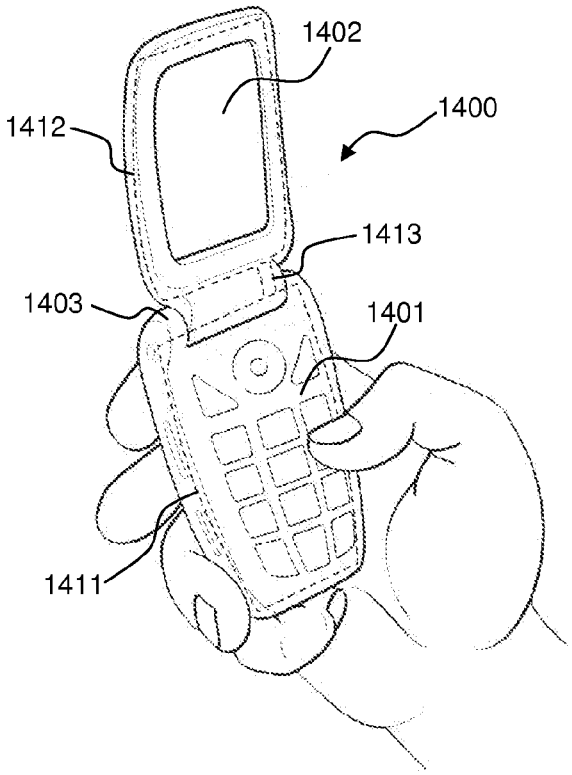
FIG. 14—Example of a wireless handheld or portable device comprising two bodies.

Referring now to FIG. 14, it is there shown a wireless handheld or portable device 1400 comprising two bodies arranged in a clamshell-type configuration in which a radiating system according to the present invention can be integrated.

The wireless device 1400 comprises a first body 1401, which includes among other elements a keypad, and a second body 1402, including among other elements a display. The wireless device 1400 further comprises a hinge means 1403 that connects mechanically the two bodies 1401, 1402 together. The hinge means 1403 allows the second body 1402 to pivotally move around an axis so that the wireless device 1400 can be switched between a closed position, in which the second body 1402 is substantially arranged on top of the first body 1401, and an open position, in which the first body 1401 extends away from the hinge means 1403 along a first direction (e.g., downwards in the figure) and the second body 1402 extends away from the hinge means 1403 along a second direction (e.g., upwards in the figure) different from the first direction.

The first body 1401 includes a first ground plane layer 1411, which is fully contained within said first body 1401. Similarly, the second body 1402 includes a second ground plane layer 1412, which is fully contained within said second body 1402. Finally, the wireless device 1400 comprises a ground connection means 1413 that connects electrically the first ground plane layer 1411 and the second ground plane layer 1412.

In this example, the ground connection means 1413 comprises a conductive strip which is arranged proximate to the hinge means 1403.

FIG. 15 shows another preferred example of a radiating structure suitable for a radiating system operating in a first frequency region and in a second frequency region of the electromagnetic spectrum. In this example, the radiating structure could be integrated in a two-body wireless handheld or portable device, such as the device 1400 in FIG. 14.

The radiating structure 1500 comprises a first ground plane layer 1511 and a second ground plane layer 1512 connected electrically by means of a ground connection means 1513. The first ground plane layer 1511 and the second ground plane layer 1512 could each be integrated in a different multilayer PCB contained, respectively, in a first body and in a second body of the two-body wireless device.

The ground connection means 1513 takes in this particular case the form of a flexible conductive strip, although in another example it could be a flexible film including a plurality of conductive traces. One or more of said conductive traces are used to balance the ground potential between the two ground plane layers, while some other trace or traces carry electrical signals between electronic components mounted on one of the two multilayer PCBs and those electronic components mounted on the other. Such ground connection means 1513 is advantageously integrated in a hinge means of the wireless handheld or portable device (such as the hinge means 1403 in FIG. 14).

Figure 15A:
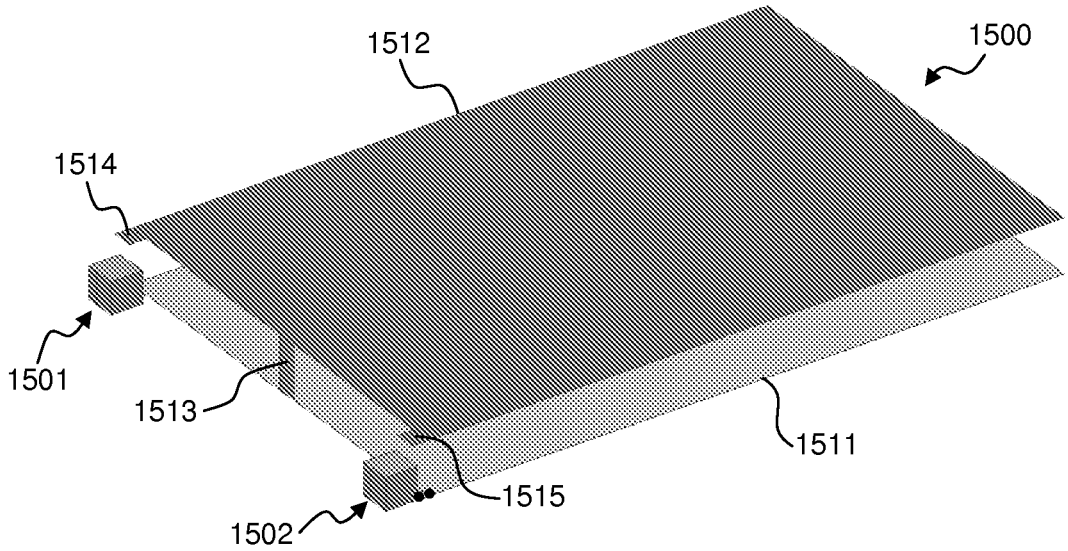
FIG. 15—Example of a radiating structure comprising a first and a second ground plane layer suitable for a radiating system to be integrated in a wireless device having two bodies that can be arranged in (a) a closed position, and in (b) an open position.
Figure 15B:
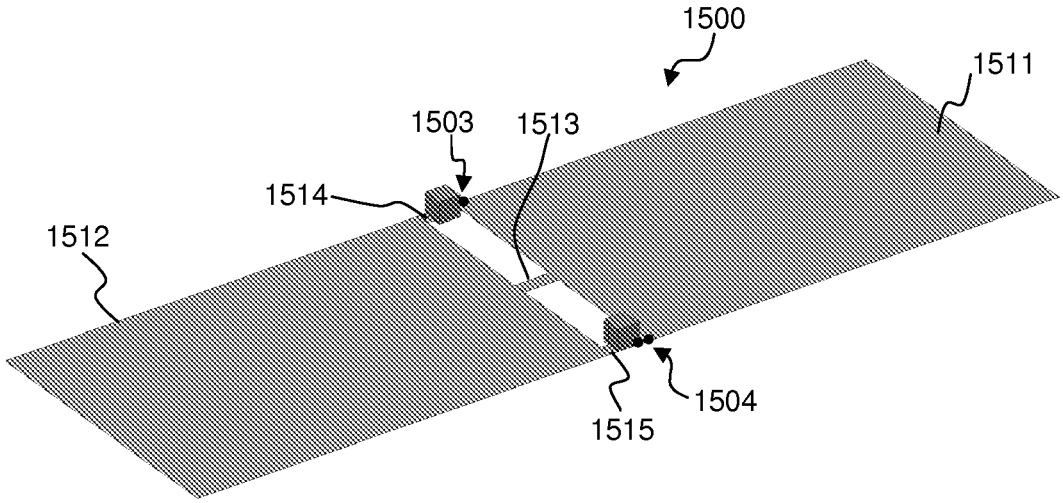

In particular, in FIG. 15*a* it is shown the relative position of the first and second ground plane layers 1511, 1512 when the two bodies of the wireless device are arranged in the closed position, in which the second ground plane layer 1512 is substantially on top of the first ground plane layer 1511. The relative position of the two ground plane layers 1511, 1512 when the wireless is in the open position is represented in FIG. 15*b*, in which the first ground plane layer 1511 and the second ground plane layer 1512 extend away from the ground connection means 1513 (and hence from the hinge means) in substantially opposite directions.

The radiating system further comprises a first radiation booster 1501 and a second radiation booster 1502, which are equal in shape, dimensions and topology to the radiation boosters already described in connection with the example in FIG. 4.

The first radiation booster 1501 includes a connection point that defines together with a first connection point of the first ground plane layer 1511 a first internal port 1503. Similarly, the second radiation booster 1502 includes also a connection point that defines together with a second connection point of the first ground plane layer 1511 a second internal port 1504.

In the radiating structure 1500, the first radiation booster 1501 and the second radiation booster 1502 protrude beyond the first ground plane layer 1511. The first radiation booster 1501 is located substantially close to a first corner of the first ground plane layer 1511, while the second radiation booster 1502 is located substantially close to a second corner of the first ground plane layer 1511. In particular, said first and second corners are at opposite ends of a short edge of the first ground plane layer 1511, which has a substantially rectangular shape.

Additionally, the ground connection means 1513 connects to said short edge of the first ground plane layer 1511 substantially close to its center; so that there is a radiation booster arranged on both sides of said ground connection means 1513.

The second ground plane layer 1512 comprises a first contact member 1514 located substantially close to a first corner of the second ground plane layer 1512 and a second contact member 1515 located substantially close to a second corner of the second ground plane layer 1512. Said first and second corners are at opposite ends of a short edge of the second ground plane layer 1512.

When the wireless device is in the open position (FIG. 15*b*), the first contact member 1514 contacts the first radiation booster 1501 and the second contact member 1515 contacts the second radiation booster 1502. Therefore, in the open position, the second ground plane layer 1512 establishes electrical contact with both radiation boosters 1501, 1502.

On the other hand, when the wireless device is in the closed position (FIG. 15*a*), the first and second contact members 1514, 1515 do not contact any of the radiation boosters 1501, 1502.

Figure 16:
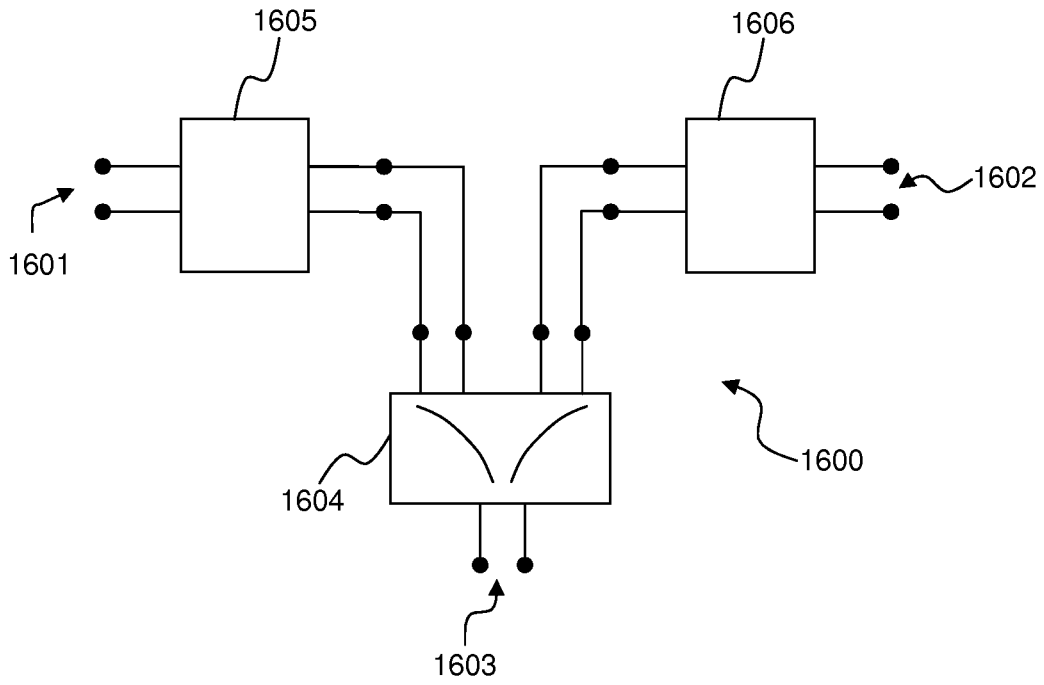
FIG. 16—Schematic representation of a radiofrequency system for a radiating system whose radiating structure is shown in FIG. 15.

FIG. 16 shows an example of a radiofrequency system suitable for interconnection with the radiating structure of FIG. 15. The radiofrequency system 1600 comprises a diplexer 1604 to separate/recombine the electrical signals of a first and a second frequency regions of operation of a radiating system, a first matching network 1605 to provide impedance matching in said first frequency region, and a second matching network 1606 to provide impedance matching in said second frequency region.

Each of the first and second matching networks 1605, 1606 may be as in any of the examples of matching networks described in connection with FIG. 3.

The first matching network 1605 is connected to a first port 1601, while the second matching network 1606 is connected to a second port 1602. The diplexer 1604 is connected to a third port 1603. When a radiating system uses the radiating structure 1500 in combination with the radiofrequency system 1600, the first and second internal ports 1503, 1504 would be connected to the first and second ports 1601, 1602 respectively. Finally, the third port 1603 would be connected to an external port of the radiating system.

Figure 17:
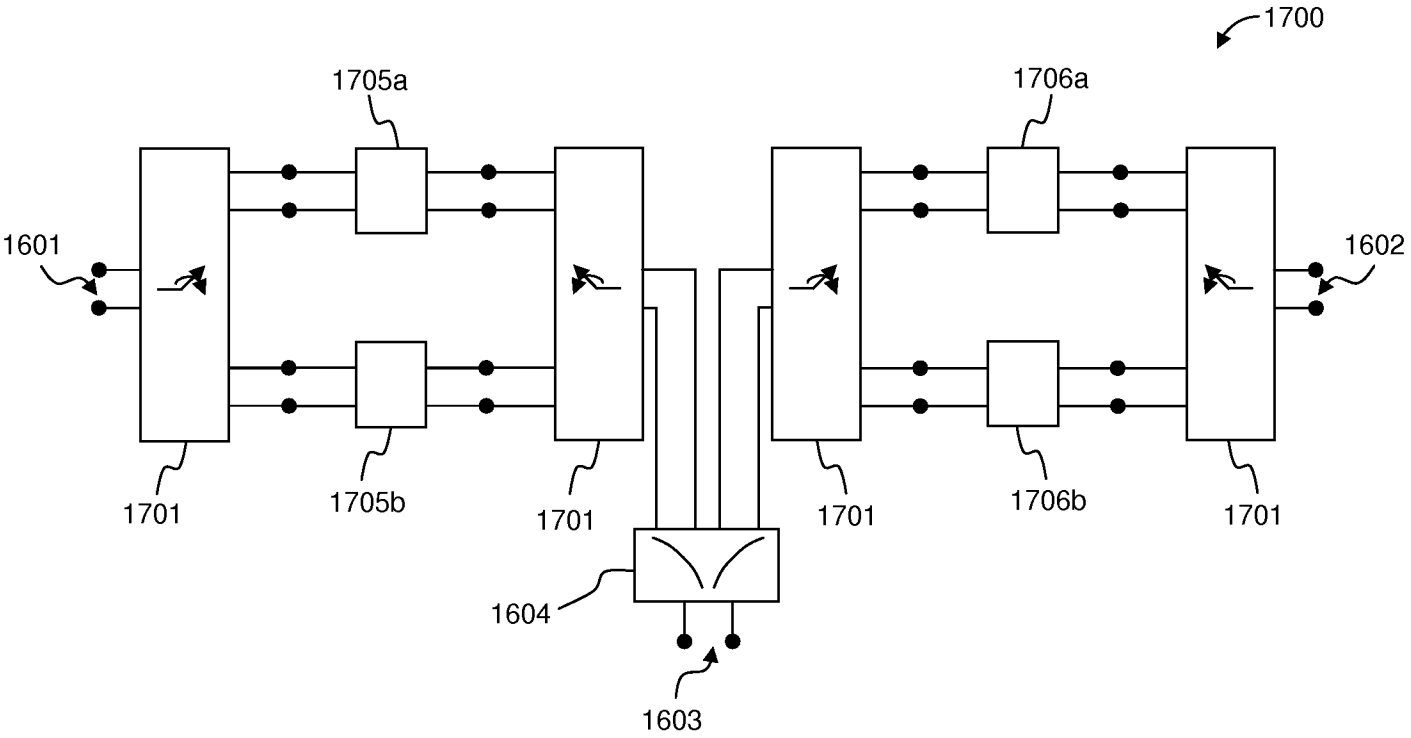
FIG. 17—Schematic representation of a radiofrequency system including switching means, the radiofrequency system being suitable for a radiating system whose radiating structure is shown in FIG. 15.

Referring now to FIG. 17, it is there represented an alternative example of a radiofrequency system suitable for a radiating structure such as the one in FIG. 15.

Given the fact that the input impedance of the first and second internal ports 1503, 1504 of the radiating structure 1500 when disconnected from a radiofrequency system may be different depending on whether the wireless device is in the closed position or in the open position, a radiofrequency system 1700 comprises two matching networks 1705*a*, 1705*b* designed to provide impedance matching in the first frequency region of operation, and two matching networks 1706*a*, 1706*b* designed to provide impedance matching in the second frequency region of operation.

The radiofrequency system 1700 further includes a switching means 1701 to select between a first set of matching networks 1705*a*, 1706*a* specially adapted for the case in which the wireless device is in the closed position and a second set of matching networks 1705*b*, 1706*b* specially adapted for the case in which the wireless device is in the open position.

Even though that in the illustrative examples described above in connection with the figures some particular designs of radiation boosters have been used, many other designs of radiation boosters having for example different shape and/or dimensions could have been equally used in the radiating structures.

In that sense, although the first and second radiation boosters in FIGS. 4 and 15, and the first radiation booster in FIG. 11, have a volumetric geometry, other designs of substantially planar radiation boosters could have been used instead.

Also, even though that some examples of radiating structures (such as for instance those in FIG. 4, 11 or 15) have been described as comprising radiation boosters having a conductive part, other possible examples could have been constructed using radiation boosters comprising a gap defined in the at least one ground plane layer of the radiating structure.

In some embodiments, a radiating structure includes a ground plane layer (such as for instance a first ground plane layer) and a radiation booster that comprises a gap defined in said ground plane layer. The gap is delimited by a plurality of segments defining a curve, which may preferably intersect the perimeter of said ground plane layer. In those cases, said radiation booster comprises a connection point located at a first point along said curve. A connection point of said ground plane layer is located at a second point along said curve, said second point being different from said first point. The radiating structure also comprises an internal port defined between the connection point of the radiation booster (i.e., the first point of the curve) and the connection point of the ground plane layer (i.e., the second point of the curve).

In the same way, despite the fact that the first and second radiation boosters in FIGS. 4 and 15 have been chosen to be equal in topology (i.e., a volumetric versus a planar geometry), shape and size, they could have been selected to have different topology, shape and/or size, while preserving for example the relative location of the radiation boosters with respect to each other and with respect to the at least one ground plane layer.

What is claimed is:

1. A wireless handheld or portable device, comprising:

a first body;

a second body;

a hinge mechanically connecting the first and second bodies, the hinge allowing at least one of the first and second bodies to pivotally move about an axis such that the wireless device is switchable between a closed position in which one of the first and second bodies is substantially arranged on top of the other of the first and second bodies and an open position in which the first body extends away from the hinge along a first direction and the second body extends away from the hinge along a second direction different from the first direction; and a communication module including a radiating system capable of transmitting and receiving electromagnetic wave signals in a first frequency region and in a second frequency region, wherein the highest frequency of the first frequency region is lower than the lowest frequency of the second frequency region;

wherein the radiating system comprises a radiating structure comprising:

a first ground plane layer capable of supporting at least one radiation mode, the first ground plane layer being contained within the first body of the wireless device and including at least one connection point;

a second ground plane layer contained within the second body of the wireless device;

a ground connector electrically connecting the first ground plane layer and the second ground plane layer;

at least one radiation booster configured to couple electromagnetic energy to/from the first ground plane layer, the at least one radiation booster including a connection point;

at least one internal port defined between the connection point of one of the at least one radiation booster and one of the at least one connection point of the first ground plane layer, wherein the second ground plane layer establishes electrical contact with one or more of the at least one radiation booster when the wireless device is in the open position but not when the wireless device is in the closed position; and a radiofrequency system, and an external port, the radiofrequency system comprising a port connected to each of the at least one internal port of the radiating structure and a port connected to the external port of the radiating system;

wherein, when the wireless device is in the closed position, the input impedance of the radiating structure at each of the at least one internal port when disconnected from the radiofrequency system has an imaginary part not equal to zero for any frequency of the first frequency region; and wherein said radiofrequency system modifies the impedance of the radiating structure, providing impedance matching to the radiating system in the at least two frequency regions of operation of the radiating system both when the wireless device is in the closed position and in the open position.

2. The wireless handheld or portable device of claim 1, wherein operation of the second ground plane layer as a radiating element, when the wireless device is in the open position, complements operation of the at least one radiation booster.

3. The wireless handheld or portable device of claim 1, wherein the at least one radiation booster is located substantially close to the hinge such that, when the wireless device is in the open position, the at least one radiation booster lies between the first ground plane layer and the second ground plane layer.

4. The wireless handheld or portable device of claim 1, wherein the at least one radiation booster is substantially close to a short edge of the first ground plane layer, said short edge being a same edge to which the ground connector is connected.

5. The wireless handheld or portable device of claim 1, wherein the radiating structure comprises first and second radiation boosters.

6. The wireless handheld or portable device of claim 5, wherein each of the first and second radiation boosters is substantially close to one end of two opposite ends of a short edge of the first ground plane layer, wherein said short edge is proximate to the hinge and is a same edge to which the ground connector is connected.

7. The wireless handheld or portable device of claim 1, wherein, when the wireless device is in the open position, each of the at least one radiation booster is operable only to drive the second ground plane layer and not to couple electromagnetic energy to/from the first ground plane layer.

8. The wireless handheld or portable device of claim 1, wherein each of the at least one radiation booster has a volumetric geometry.

9. The wireless handheld or portable device of claim 1, wherein the ground connector is located proximate to the hinge of the wireless device and electrically connects a short edge of the first ground plane layer with a short edge of the second ground plane layer.

10. The wireless handheld or portable device of claim 1, wherein the ground connector comprises a choke to effectively disconnect the second ground plane layer from the first ground plane layer for the frequencies of the first and second frequency ranges.

11. The wireless handheld or portable device of claim 1, wherein the radiofrequency system comprises as many matching networks as there are radiation boosters in the radiating structure.

12. A wireless handheld or portable device, comprising:

a first body;

a second body;

a hinge mechanically connecting the first and second bodies, the hinge allowing at least one of the first and second bodies to pivotally move about an axis such that the wireless device is switchable between a closed position in which one of the first and second bodies is substantially arranged on top of the other of the first and second bodies and an open position in which the first body extends away from the hinge along a first direction and the second body extends away from the hinge along a second direction different from the first direction; and a communication module including a radiating system configured to transmit and receive electromagnetic wave signals in a first frequency region and in a second frequency region, wherein the highest frequency of the first frequency region is lower than the lowest frequency of the second frequency region;

wherein the radiating system comprises a radiating structure comprising:

a first ground plane layer capable of supporting at least one radiation mode, the first ground plane layer being contained within the first body of the wireless device and including a connection point;

a second ground plane layer contained within the second body of the wireless device;

a ground connector electrically connecting the first ground plane layer and the second ground plane layer;

a first radiation booster configured to couple electromagnetic energy to/from the first ground plane layer, the first radiation booster including a connection point;

a first internal port defined between the connection point of the first radiation booster and the connection point of the first ground plane layer; and a radiofrequency system and at least one external port, the radiofrequency system comprising a port connected to the first internal port, and a port connected to one of the at least one external port of the radiating system;

wherein the first radiation booster is substantially proximate to an end of a first edge of the first ground plane layer;

wherein the ground connector is connected to the first ground plane layer at the first edge of the first ground plane layer;

wherein, when the wireless device is in the open position, the second ground plane layer makes electrical contact with the first radiation booster, and the second ground plane layer operates as a radiating element; and wherein the radiofrequency system modifies the impedance of the radiating structure providing impedance matching to the radiating system in the at least two frequency regions of operation of the radiating system both when the wireless device is in the closed position and in the open position.

13. The wireless handheld or portable device of claim 12, wherein the first radiation booster has a volumetric geometry.

14. The wireless handheld or portable device of claim 12, wherein the radiofrequency system comprises as many matching networks as there are frequency regions of operation of the radiating system.

15. The wireless handheld or portable device of claim 12, wherein:

the second ground plane layer includes a connection point;

the radiating structure comprises:

a second radiation booster configured to couple electromagnetic energy to/from the second ground plane layer, the second radiation booster including a connection point; and a second internal port defined between the connection point of the second radiation booster and the connection point of the second ground plane layer; and the radiofrequency system comprises a port connected to the second internal port of the radiating structure and a port connected to one of the at least one external port of the radiating system.

16. A wireless handheld or portable device, comprising:

a first body;

a second body;

at least one hinge mechanically connecting the first and second bodies, the at least one hinge allowing at least one of the first and second bodies to pivotally move about an axis such that the wireless device is switchable between a closed position in which one of the first and second bodies is substantially arranged on top of the other of the first and second bodies and an open position in which the first body extends away from the at least one hinge along a first direction and the second body extends away from the at least one hinge along a second direction different from the first direction; and a communication module including a radiating system configured to transmit and receive electromagnetic wave signals in a first frequency region and in a second frequency region, wherein the highest frequency of the first frequency region is lower than the lowest frequency of the second frequency region;

wherein the radiating system comprises a radiating structure comprising:

a first ground plane layer contained within the first body, a second ground plane layer contained within the first body, and a third ground plane layer contained within the second body;

a ground connector electrically connecting the first ground plane layer with the second ground plane layer;

a first radiation booster configured to couple electromagnetic energy to/from one of the first and second ground plane layers, the first radiation booster including a connection point;

a second radiation booster configured to couple electromagnetic energy to/from one of the first and second ground plane layers, the second radiation booster including a connection point;

a first internal port defined between the connection point of the first radiation booster and a connection point of the one of the first and second ground plane layers that the first radiation booster is configured to couple electromagnetic energy to/from;

a second internal port defined between the connection point of the second radiation booster and a connection point of the one of the first and second ground plane layers that the second radiation booster is configured to couple electromagnetic energy to/from; and a radiofrequency system and at least one external port, the radiofrequency system comprising a first port connected to the first internal port, a second port connected to the second internal port, and a third port connected to the at least one external port of the radiating system;

wherein, when the wireless device is in the open position, the third ground plane layer is electrically connected to at least one of the first and second radiation boosters;

wherein, when the wireless device is in the closed position, the input impedance of the radiating structure at each of the first and second internal ports when disconnected from the radiofrequency system has an imaginary part not equal to zero for any frequency of the first frequency region;

wherein, when the wireless device is in the closed position, the third ground plane layer does not act as a radiating element; and wherein the radiofrequency system modifies the impedance of the radiating structure, providing impedance matching to the radiating system in the at least two frequency regions of operation of the radiating system both when the wireless device is in the closed position and in the open position.

17. The wireless handheld or portable device of claim 16, wherein:

the third ground plane layer includes a connection point;

the radiating structure comprises:

a third radiation booster configured to couple electromagnetic energy to/from the third ground plane layer, the third radiation booster including a connection point; and a third internal port defined between the connection point of the third radiation booster and the connection point of the third ground plane layer; and the radiofrequency system comprises a port connected to the third internal port.

18. The wireless handheld or portable device of claim 17, wherein operation of the third radiation booster, when the wireless device is in the open position, is complemented by operation of the third ground plane layer as a radiating element.

19. The wireless handheld or portable device of claim 16, wherein each of the first and second radiation boosters has a volumetric geometry.

20. The wireless handheld or portable device of claim 16, wherein at least one of the first and second radiation boosters is located substantially close to the hinge such that, when the wireless device is in the open position, the at least one of the first and second radiation boosters lies between the third ground plane layer and the first or second ground plane layer.

* * * * *